US008631972B2

(12) United States Patent
Kessler et al.

(10) Patent No.: US 8,631,972 B2
(45) Date of Patent: Jan. 21, 2014

(54) METERING SYSTEM WITH COMPONENT SUPPORT

(75) Inventors: Arnd Kessler, Monheim am Rhein (DE); Salvatore Fileccia, Oberhausen (DE); Hans-Georg Mühlhausen, Düsseldorf (DE); Gerold Jans, Waldburg (DE); Roland Schmalz, Waldburg (DE); Ba Loc Nguyen, Neukirch (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 369 days.

(21) Appl. No.: 12/987,681

(22) Filed: Jan. 10, 2011

(65) Prior Publication Data

US 2011/0139820 A1 Jun. 16, 2011

Related U.S. Application Data

(63) Continuation of application No. PCT/EP2009/058972, filed on Jul. 14, 2009.

(30) Foreign Application Priority Data

Jul. 15, 2008 (DE) ..... 10 2008 033 109

(51) Int. Cl.
*B67D 7/74* (2010.01)

(52) U.S. Cl.
USPC ..... 222/129; 134/99.2

(58) Field of Classification Search
USPC ..... 222/129, 129.1, 52, 1, 325–327, 222/148–151; 134/93, 57 D, 56 D, 58 D, 18, 134/99.2
See application file for complete search history.

(56) References Cited

U.S. PATENT DOCUMENTS

| | | | | | |
|---|---|---|---|---|---|
| 5,176,297 | A * | 1/1993 | Mooney et al. | ..... | 222/325 |
| 5,261,432 | A * | 11/1993 | Sandrin | ..... | 134/93 |
| 6,434,977 | B1 * | 8/2002 | Hapke et al. | ..... | 68/17 R |
| 6,826,933 | B2 * | 12/2004 | Merkle et al. | ..... | 68/17 R |
| 8,381,744 | B2 * | 2/2013 | Classen et al. | ..... | 134/99.2 |
| 8,382,913 | B2 * | 2/2013 | Classen et al. | ..... | 134/58 D |
| 2011/0297238 | A1 * | 12/2011 | Ashton et al. | ..... | 137/2 |

FOREIGN PATENT DOCUMENTS

| | | | | |
|---|---|---|---|---|
| DE | 27 03 296 | B2 | 8/1978 | |
| DE | 10 2006 043 916 | A1 | 3/2008 | |
| DE | 10 2006 043 973 | A1 | 3/2008 | |
| DE | 102007014425 | * | 9/2008 | ..... 134/58 D |
| EP | 0 423 044 | B1 | 4/1991 | |
| EP | 0 461 870 | A2 | 12/1991 | |
| FR | 2 515 220 | | 4/1983 | |
| WO | WO 01/73182 | A2 | 10/2001 | |
| WO | WO 02/29150 | A1 | 4/2002 | |

* cited by examiner

*Primary Examiner* — Lien Ngo
(74) *Attorney, Agent, or Firm* — David K. Benson

(57) ABSTRACT

A dispensing system for the interior of a dishwashing machine includes a component carrier on which components are detachably or nondetachably arranged, including at least a dispensing chamber, an actuator, and a closing element as well as an energy source and/or a control unit and/or a sensor unit. The closing element is coupled with the actuator such that movement of the actuator displaces the closing element into a closure or a release position. The at least one dispensing chamber is connected in communicating manner with at least one cartridge chamber and includes an inlet for inflow of washing or cleaning agent from a cartridge chamber and an outlet for outflow of washing or cleaning agent from the dispensing chamber into its surrounding environment. The outlet of the dispensing chamber is closable or openable by the closing element.

14 Claims, 13 Drawing Sheets

METERING SYSTEM WITH COMPONENT SUPPORT

CROSS-REFERENCES TO RELATED APPLICATIONS

This is a continuation of International Application No. PCT/EP2009/058972, filed Jul. 14, 2009, which claims priority to German Patent Application No. DE 10 2008 033 109.0, filed Jul. 15, 2008, both of which are hereby incorporated by reference.

FIELD OF THE INVENTION

The present invention relates to a dispensing system with a component carrier for accommodating assemblies for releasing a plurality of preparations for use in water-conveying appliances, and more particularly relates to water-conveying domestic appliances such as for example dishwashing machines, washing machines, washer/dryers or automatic surface cleaning systems.

BACKGROUND OF THE INVENTION

Dishwashing agents are available to consumers in numerous presentations. In addition to traditional liquid manual dishwashing agents, automatic dishwashing agents have in particular become increasingly significant as domestic dishwashing machines have become more common. These automatic dishwashing agents are typically offered for sale to the consumer in solid form, for example as a powder or as tablets, but increasingly also in liquid form. For some considerable time, attention has focused on convenient dispensing of washing and cleaning agents and on simplifying the operations required to carry out a washing or cleaning method.

Furthermore, one of the main objectives of manufacturers of automatic cleaning agents is to improve the cleaning performance of these agents, increasing attention having been paid in recent times to cleaning performance in low temperature cleaning cycles or in cleaning cycles with reduced water consumption. To this end, new ingredients, for example more highly active surfactants, polymers, enzymes or bleaching agents have been added to the cleaning agents. However, since new ingredients are only available to a limited extent and the quantity of the ingredients used per cleaning cycle cannot be increased at will for environmental and economic reasons, there are natural limits to this approach to solving the problem.

In this connection, devices for multiple dispensing of washing and cleaning agents have recently in particular come to the attention of product developers. In terms of these devices, a distinction may be drawn between dispensing chambers integrated into the dishwashing machine or washing machine, on the one hand, and separate devices independent of the dishwashing machine or washing machine, on the other hand. These devices, which contain a multiple of the quantity of cleaning agent required to carry out a cleaning method, automatically or semi-automatically dispense washing or cleaning agent portions into the interior of the cleaning machine over the course of a plurality of successive cleaning processes. For the consumer, manual dispensing for each cleaning or washing cycle is no longer necessary. Examples of such devices are described in European patent application EP 1 759 624 A2 (Reckitt Benckiser) or in German patent application DE 53 5005 062 479 A1 (BSH Bosch and Siemens Hausgeräte GmbH).

Accordingly, it is desirable to enable the simplest possible, preferably automatic manufacture of the dispenser so that such a dispenser may be produced in a simple and inexpensive manner. Furthermore, other desirable features and characteristics of the present invention will become apparent from the subsequent detailed description of the invention and the appended claims, taken in conjunction with the accompanying drawings and this background of the invention.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

Figure 1:
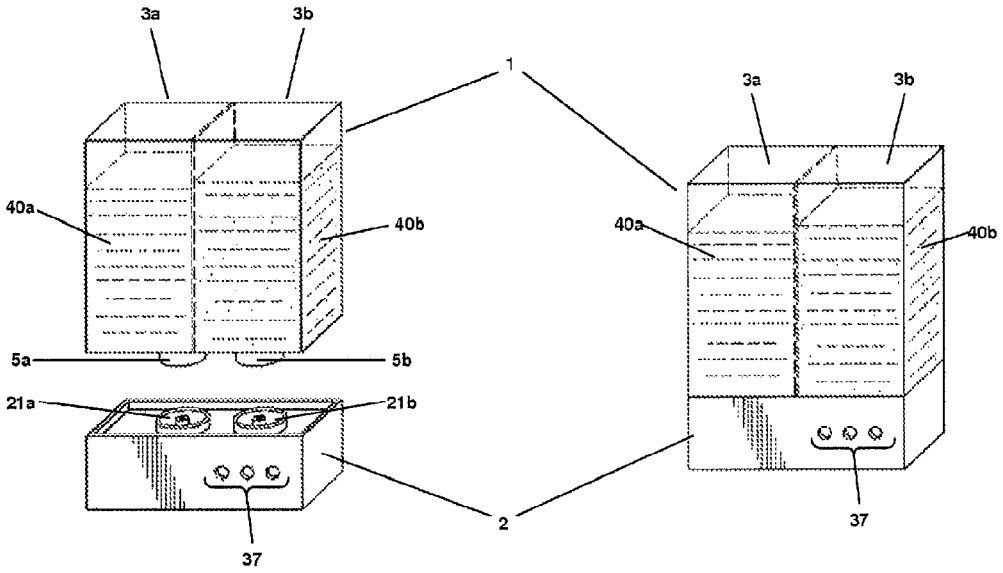
FIG. 1 is a diagram depicting an autonomous dispenser with a two-chamber cartridge in the separated and assembled states according to an embodiment of the present invention.

The following detailed description of the invention is merely exemplary in nature and is not intended to limit the invention or the application and uses of the invention. Furthermore, there is no intention to be bound by any theory presented in the preceding background of the invention or the following detailed description of the invention.

An object of the invention is accordingly to provide a dispensing system which may be manufactured in the simplest possible manner, in a few, as far as possible automatic manufacturing steps.

Advantages of the system according to the invention are, on the one hand, simple population of the component carrier with the necessary components and assemblies and the possibility of having said population carried out with the assistance of automatic handling and/or production systems. It is furthermore possible to preassemble the component carrier in its entirety and to insert it into the dispenser.

The dispensing system according to the invention consists of the basic components of a cartridge filled with preparation and a dispenser couplable with the cartridge, which is in turn formed of further assemblies, such as for example component carrier, actuator, closing element, sensor, energy source and/or control unit.

It is preferred for the dispensing system according to the invention to be mobile. For the purposes of the present application, mobile means that the dispensing system is not non-detachably connected to a water-conveying device, such as for example a dishwashing machine, washing machine, washer/dryer or the like, but may instead be removed for example from a dishwashing machine by the user or be positioned in a dishwashing machine, i.e. may be handled separately.

According to an alternative development of the invention, it is also conceivable for the dispenser to be connected non-detachably for the user to a water-conveying device such as for example a dishwashing machine, washing machine, washer/dryer or the like and for only the cartridge to be mobile.

In order to ensure operation at elevated temperatures, as may for example occur in individual washing cycles of a dishwashing machine, the dispensing system may be formed from materials which are dimensionally stable up to a temperature of 120° C.

Since, depending on the intended purpose, the preparations to be dispensed may have a pH value of between 2 and 12, any components of the dispensing system which come into contact with the preparations should exhibit appropriate acid and/or alkali resistance. In addition, suitable material selection should ensure that these components are as far as possible chemically inert, for example in relation to nonionic surfactants, enzymes and/or scents.

Cartridge:

For the purposes of the present application, a cartridge is understood to be a packaging means which is suitable for enclosing or holding together at least one flowable, pourable or sprinklable preparation and is couplable to a dispenser for release of at least one preparation.

In the simplest conceivable embodiment, the cartridge comprises a single, preferably dimensionally stable, chamber for storing a preparation. In particular, a cartridge may also comprise a plurality of chambers which may be filled with different compositions.

It is advantageous for the cartridge to comprise at least one outlet orifice which is arranged such that gravity-actuated release of preparation from the cartridge may be brought about in the service position of the dispenser. In this way, no further conveying means are required for release of preparation from the cartridge, whereby the structure of the dispenser may be kept simple and manufacturing costs low. Moreover, it is possible to dispense with the use of conveying means, such as for example pumps, whereby the service life of a battery or storage battery of the dispenser may be increased.

In a preferred development of the invention, at least one second chamber is provided for accommodating at least one second flowable or sprinklable preparation, the second chamber comprising at least one outlet orifice which is arranged such that gravity-actuated product release from the second chamber may be brought about in the service position of the dispenser. The arrangement of a second chamber is particularly advantageous when preparations are stored in the mutually separate chambers of the cartridge which are not conventionally stable in storage together, such as for example bleaching agents and enzymes.

It is also conceivable for more than two, in particular three to four chambers to be provided in or on a cartridge. In particular, one of the chambers may be designed to release volatile preparations such as for instance a scent into the surrounding environment.

In a further development of the invention the cartridge is of single-part construction. In this way, the cartridges may be produced inexpensively in a single production step, in particular by suitable blow molding methods. The chambers of a cartridge may in this case be separated from one another for example by webs or material bridges, which are formed during or after blow molding.

The cartridge may also be of multipart construction, being made of components which are produced by injection molding and then assembled.

In particular, the cartridge may also be of asymmetric construction. It is particularly preferred to make the asymmetry of the cartridge such that the cartridge is only couplable with the dispenser in a predefined position, so preventing incorrect operation by the user which would otherwise be possible.

The cartridge may be of any desired three-dimensional shape. It may for example be cubic, spherical or plate-like in form.

When using the dispenser in dishwashing machines, it is particularly advantageous to shape the device on the basis of the dishes to be cleaned in dishwashing machines. It may, for example, be plate-shaped, approximately assuming the dimensions of a plate. In this way, the dispenser may be positioned in space-saving manner for example in the lower basket of the dishwasher. Furthermore, the correct positioning of the dispensing unit is immediately obvious to the user thanks to the plate-like shape.

In the coupled state, the dispenser and cartridge preferably have a ratio of height:width:depth of between 5:5:1 and 50:50:1, particularly preferably of around 10:10:1. Due to the "slender" construction of the dispenser and the cartridge it is in particular possible to position the device in the lower basket of a dishwashing machine in the receptacles provided for plates. This has the advantage that the preparations released from the dispenser pass directly into the washing liquor and cannot adhere to other items being washed.

Conventional commercial domestic dishwashing machines are usually designed such that larger items to be washed, such as for instance pans or large plates, are arranged in the lower basket of the dishwashing machine. In order to prevent the user from positioning the dispensing system consisting of the dispenser and the cartridge coupled with the dispenser less than ideally in the upper basket, in an advantageous development of the invention the dispensing system is dimensioned such that the dispensing system may only be positioned in the receptacles provided for this purpose in the lower basket. To this end, the width and height of the dispensing system may in particular be selected between 150 mm and 300 mm, particularly preferably between 175 mm and 250 mm.

It is, however, also conceivable to construct the dispensing unit in a cup or pot shape with a substantially circular or square base area.

The outlet orifices of a cartridge are preferably arranged in a line, so making a slender, plate-shaped configuration of the dispenser possible.

The cartridge is in particular constructed to accommodate flowable rinsing or washing or cleaning agents. Such a cartridge particularly preferably comprises a plurality of chambers for spatially separately accommodating in each case different preparations of a washing or cleaning agent. By way of non-exhaustive example, some possible combinations for filling the chambers with different preparations are listed below:

| | Chamber 1 | Chamber 2 | Chamber 3 | Chamber 4 |
|---|---|---|---|---|
| A | Alkaline cleaning preparation | Enzymatic cleaning preparation | — | — |
| B | Alkaline cleaning preparation | Enzymatic cleaning preparation | Rinse aid | — |
| C | Alkaline cleaning preparation | Enzymatic cleaning preparation | Rinse aid | Scent |
| D | Alkaline cleaning preparation | Enzymatic cleaning preparation | Rinse aid | Disinfectant preparation |
| E | Alkaline cleaning preparation | Enzymatic cleaning preparation | Rinse aid | Pretreatment preparation |

It is particularly preferred for all preparations to be flowable, since this ensures rapid dissolution of the preparations in the washing liquor of the dishwasher, as a result of which these preparations have a rapid to immediate cleaning or rinsing action, in particular also on the walls of the washing compartment and/or of a light guide of the cartridge and/or of the dispenser.

The chambers of a cartridge may be of identical or different capacities. In a configuration with two chambers, the ratio of the chamber volumes is preferably 5:1; in a configuration with three chambers preferably 4:1:1, these configurations in particular being suitable for use in dishwashing machines.

As mentioned above, the cartridge preferably has three chambers. When such a cartridge is used in a dishwashing machine, it is particularly preferred for one chamber to contain an alkaline cleaning preparation, another chamber an enzymatic preparation and a third chamber a rinse aid, the volume ratio of the chambers amounting to approximately 4:1:1.

The chamber containing the alkaline cleaning preparation preferably has the greatest capacity of the chambers present. The chambers which store an enzymatic preparation or a rinse aid preferably have approximately identical capacities.

In a two and/or three chamber configuration of the cartridge, it is in particular possible to store in particular a scent, disinfectant and/or pretreatment preparation in a further chamber arranged detachably on the cartridge or on the dispenser.

The cartridge comprises a cartridge bottom, which in the service position is directed downwards in the direction of gravity and in which, preferably for each chamber, there is provided at least one outlet orifice arranged at the bottom in the direction of gravity. The outlet orifices arranged at the bottom are in particular constructed such that at least one, preferably all of the outlet orifices may be connected in communicating manner with the inlet orifices of the dispenser, such that preparation can flow out of the cartridge via the outlet orifices into the dispenser, preferably under the action of gravity.

It is also conceivable for one or more chambers to comprise an outlet orifice which is not arranged at the bottom in the direction of gravity. This is in particular advantageous when for example a scent is to be released into the surrounding environment of the cartridge.

The cartridge is preferably formed of at least two elements which are bonded together, the connecting edge of the elements at the cartridge bottom extending at a distance from the outlet orifices such that the connecting edge does not intersect with the outlet orifices. This is in particular advantageous because in this way leakage problems in the area of the outlet orifices are avoided on coupling with the dispenser, which problems in particular occur on exposure to the major cyclic fluctuations in temperature which conventionally occur in a dishwasher.

The bonded connection may be produced, for example, by adhesive bonding, welding, brazing, pressing or vulcanization.

According to one embodiment of the invention which is to be preferred, the outlet orifices are in each case provided with a closure which, when in the state coupled with a dispenser, permits outflow of preparation from the respective chambers and, when in the uncoupled state of the cartridge, substantially prevents outflow of preparation. Such a closure in particular takes the form of a silicone slit valve.

It is furthermore preferred for the ventilation orifices of the cartridge to be closed with a closing element before it is first coupled with the dispenser. The closing element may in particular be a stopper or cap which is opened, for example pierced, by the coupling process when it is first coupled with the dispenser.

Before the cartridge is first coupled with the dispenser, it is very particularly preferred for all outlet orifices of the cartridge to be closed with a silicone slit valve and all ventilation orifices with a cap.

In a further development of the invention, an energy source, in particular a battery or storage battery, is arranged on or in the cartridge, preferably on or in the bottom of the cartridge. Means for coupling the energy source electrically with the dispenser may furthermore be provided on the cartridge.

In a further, preferred development of the invention the cartridge for coupling with a dispenser positionable in the interior of a domestic appliance for releasing at least one washing and/or cleaning agent preparation comprises at least one chamber for storing at least one flowable or pourable washing and/or cleaning agent preparation, in which, in the state coupled with the dispenser, the cartridge is protected from ingress of washing water into the chamber(s) and the cartridge comprises at least one release orifice at the bottom in the direction of gravity for the, in particular gravity-actuated, release of preparation from at least one chamber and at least one ventilation orifice at the bottom in the direction of gravity for the ventilation of at least one chamber, the ventilation orifice being separate from the release orifice and the ventilation orifice being connected in communicating manner with at least one cartridge chamber.

It is particularly preferred for the cartridge to comprise at least two chambers, very particularly preferably at least three chambers. It is here advantageous for in each case a ventilation orifice and a release orifice to be provided for each chamber.

It is furthermore preferred for the ventilation orifice at the bottom to be connected in communicating manner with a ventilation channel, the end of which remote from the ventilation orifice in the release position of the cartridge coupled with the dispenser opens above the maximum filling level of the cartridge.

In this connection, it is advantageous for the ventilation channel entirely or in part to be formed in or on the walls and/or webs of the cartridge. In particular, the ventilation channel may be formed integrally in or on the walls and/or webs of the cartridge.

To this end, the ventilation channel may advantageously be shaped by joining together at least two elements which form the cartridge. For example, a ventilation channel may be formed by joining a separating web of the cartridge formed in the shell-shaped element with two webs bordering the separating web and arranged on the cartridge element.

It is here advantageous for the ventilation channel to be formed by bonded joining, in particular by welding, of a separating web of the cartridge formed in the shell-shaped element with two webs bordering the separating web and arranged on the cartridge element.

Alternatively, the ventilation channel may also take the foam, for example, of a dip tube.

In order to ensure cartridge ventilation also in an inclined position, for example when the dispenser is placed in the plate receptacle, it is advantageous for the cartridge filling level (F) in the unopened, filled state of the cartridge not to reach the ventilation channel mouth in an inclined position of up to 45°.

It is moreover advantageous in this connection to arrange the ventilation channel mouth approximately centrally on or in the chamber wall of the cartridge top.

In order to ensure functionality for example also after the cartridge has been in a horizontal position, it is advantageous to configure the viscosity of a flowable preparation and the ventilation channel in such a manner that the preparation is not drawn into the ventilation channel by capillary forces when the preparation reaches the ventilation channel mouth.

Coupling of the cartridge with the dispenser should advantageously be configured such that a pin is arranged on the dispenser, which pin is connected in communicating manner with the inlet orifice of the dispenser and interacts with the couplable cartridge or cartridge chamber in such a manner that, during coupling of the ventilation orifice of cartridge or cartridge chamber with the dispenser, the pin displaces a volume $\Delta v$ in the ventilation channel, whereby a pressure $\Delta p$ is produced in the ventilation channel which is suitable for conveying the flowable preparation located in the ventilation channel into the chamber which is connected to the ventilation channel and stores the preparation.

It is preferred for the ventilation orifice of a chamber to be connected in communicating manner with the pin on the dispenser before the closed outlet orifice of the corresponding chamber is opened, for example by a communicating connection with the inlet orifice of the dispenser.

According to a further, advantageous embodiment of the invention, a ventilation chamber is arranged between the ventilation orifice and the ventilation channel.

The ratio of cartridge depth (T) to cartridge width (B) is preferably approximately 1:20. The ratio of cartridge height (H) to cartridge width (B) preferably amounts to approximately 1:1.2.

Dispenser:

The control unit necessary for operation and at least one actuator are integrated into the dispenser. A sensor unit and/or an energy source is preferably likewise arranged on or in the dispenser.

The dispenser preferably consists of a housing protected from water splashing, which prevents penetration of water splashes, as may for example occur during use in a dishwashing machine, into the interior of the dispenser, in which dispenser are arranged at least the control unit, sensor unit and/or actuator.

It is particularly advantageous to encapsulate in particular the energy source, the control unit and the sensor unit in such a manner that the dispenser is substantially water-tight, i.e. the dispenser is functional even when completely immersed in liquid. Examples of encapsulation materials which may be used are multicomponent epoxide and acrylate encapsulation compounds such as methacrylate esters, urethane meth- and cyanoacrylates or two-component materials comprising polyurethanes, silicones, epoxy resins.

An alternative or supplement to encapsulation is enclosing the components in an appropriately designed, moisture-tight housing. Such a development is further explained in greater detail below.

It is furthermore advantageous to arrange the components or assemblies on and/or in a component carrier in the dispenser; this too is further explained elsewhere.

It is furthermore advantageous for the material from which the dispenser is shaped to prevent or at least reduce biofilm growth. This may be achieved by using appropriate surface textures of the material or additives, such as for example biocides, known from the prior art. It is also conceivable to provide some areas of the dispenser at risk of microbial growth, in particular those areas in which washing water can accumulate, with a finish which prevents or at least reduces biofilm growth. Films/foils with an appropriate action may for example be used for this purpose.

It is particularly preferred for the dispenser to comprise at least one first interface which interacts with a corresponding interface provided in or on a domestic appliance, in particular a water-conveying domestic appliance, preferably a dishwashing or washing machine, such that electrical energy and/or signals is/are transmitted from the domestic appliance to the dispenser and/or from the dispenser to the domestic appliance.

In one development of the invention, the interfaces take the form of plug-in connectors. In a further development, the interfaces may be constructed such that electrical energy and/or electrical and/or optical signals are transmitted wirelessly.

It is here particularly preferred for the interfaces provided for transmitting electrical energy to be inductive transmitters and receivers of electromagnetic waves. The interface of a water-conveying appliance, such as for instance a dishwashing machine, may accordingly in particular be configured as an AC-operated transmitter coil with an iron core and the dispenser interface may be configured as a receiver coil with an iron core.

In an alternative embodiment, the transmission of electrical energy may also be provided by means of an interface which comprises, on the domestic appliance side, an electrically operated light source and, on the dispenser side, a light sensor, for example a photodiode or a solar cell. The light emitted by the light source is converted into electricity in the light sensor, which is then in turn stored, for example, by a storage battery on the dispenser side.

In an advantageous further development of the invention, an interface is provided on the dispenser and the water-conveying appliance, such as for instance a dishwashing machine, for transferring (i.e. transmitting and receiving) electromagnetic and/or optical signals, which in particular represent operating state, measurement and/or control information of the dispenser and/or of the water-conveying equipment such as a dishwashing machine.

It is, of course, possible only to provide an interface for transmitting signals or an interface for transmitting electrical energy or in each case to provide an interface for transmitting signals and an interface for transmitting electrical energy or to provide an interface with is suitable for transmitting both electrical energy and signals.

Such an interface may in particular be constructed such that electrical energy and/or electromagnetic and/or optical signals is/are transmitted wirelessly.

It is particularly preferred for the interface to be configured for emitting and/or receiving optical signals. It is very particularly preferred for the interface to be configured to emit or receive light in the visible range. Since conventionally when a dishwashing machine is in operation it is dark inside the washing compartment, signals may be emitted and/or detected by the dispenser in the visible optical range, for example in the form of signal pulses or photoflashes. It has proved particularly advantageous to use wavelengths of between 600-800 nm in the visible spectrum.

Alternatively or in addition, it is advantageous for the interface to be configured to emit or receive infrared signals. It is particularly advantageous for the interface to be configured to emit or receive infrared signals in the near infrared range (780 nm-3000 nm).

In particular, the interface comprises at least one LED. Particularly preferably, the interface comprises at least two LEDs. It is also possible according to a further development of the invention which is to be preferred to provide at least two LEDs, which emit light at different wavelengths. This makes it possible, for example, to define different signal bands on which information may respectively be transmitted or received.

In addition, it is advantageous, in a further development of the invention, for at least one LED to be an RGB LED, the wavelength of which is adjustable. Thus, for example, different signal bands which emit signals on different wavelengths may be defined with one LED. It is thus for example also conceivable for light to be emitted on a different wavelength during the drying process, during which high atmospheric humidity (fog) prevails in the washing compartment, than for example during a washing stage.

The interface of the dispenser may be configured in such a way that the LED is provided both for emitting signals inside the dishwasher, in particular when the dishwashing machine door is closed, and for optical display of an operating state, in particular when the dishwashing machine door is open.

It is particularly preferable for an optical signal to be configured as a signal pulse with a pulse duration of between 1 ms and 10 seconds, preferably between 5 ms and 100 ms.

In addition, it is advantageous for the interface of the dispenser to be configured in such a way that it emits an optical signal with the dishwashing machine closed which brings about an average illuminance E of between 0.01 and 100 lux, preferably between 0.1 and 50 lux, measured at the walls bounding the washing compartment. This illuminance is then sufficient to bring about multiple reflections with or from the other washing compartment walls and thus to reduce or prevent possible signal shadows in the washing compartment, in particular when the dishwashing machine is loaded.

The signal emitted and/or received by the interface in particular bears information, in particular being a control signal or a signal which represents an operating state of the dispenser and/or of the dishwasher.

In an advantageous further development of the invention, the dispenser for releasing at least one washing and/or cleaning agent preparation from a cartridge into the interior of a domestic appliance comprises a light source, by means of which a light signal may be incoupled into a light guide of the cartridge. The light source may in particular be an LED. This for example makes it possible to incouple light signals, for example representing the operating state of the dispenser, from the dispenser into the cartridge, such that said signals are visually perceptible on the cartridge by a user. This is in particular advantageous because, in the service position in the plate receptacle of a crockery drawer in a dishwasher, the dispenser may be visually concealed between other items to be washed. By incoupling the light from dispenser into the cartridge, the corresponding light signals may for example also be guided into the top zone of the cartridge, such that, even if the dispenser is positioned in the plate receptacle between other items to be washed, the light signals are visually perceptible by the user since, if the crockery drawer is properly loaded, the top zones of the items to be washed and of the cartridge conventionally remain uncovered.

It is furthermore possible for the light signal incoupled into and passing through the light guide of the cartridge to be detectable by a sensor located on the dispenser. This is explained in greater detail in the following section.

In a further, advantageous development, the dispenser for releasing at least one washing and/or cleaning agent preparation into the interior of a domestic appliance comprises at least one optical transmit unit, the optical transmit unit being configured such that signals from the transmit unit may be incoupled into a cartridge couplable with the dispenser and signals from the transmit unit may be emitted into the surrounding environment of the dispenser. In this way, it is possible by means of an optical transmit unit to achieve not only signal transmission between the dispenser and for example a domestic appliance such as a dishwashing machine but also signal input into a cartridge.

In particular, the optical transmit unit may be an LED which preferably emits light in the visible and/or IR range. It is also conceivable to use another suitable optical transmit unit, such as for example a laser diode. It is particularly to be preferred to use optical transmit units, which emit light in the wavelength range between 600-800 nm.

In an advantageous further development of the invention the dispenser may comprise at least one optical receive unit. This for example makes it possible for the dispenser to receive signals from an optical transmit unit arranged in the domestic appliance. This may be achieved by any suitable optical receive unit, such as for example photocells, photomultipliers, semiconductor detectors, photodiodes, photoresistors, solar cells, phototransistors, CCD and/or CMOS image sensors. It is particularly preferred for the optical receive unit to be suitable for receiving light in the wavelength range from 600-800 nm.

In particular, the optical receive unit on the dispenser may also be constructed such that the signals from the transmit unit incouplable into a cartridge coupled with the dispenser are outcouplable from the cartridge and are detectable by the optical receive unit of the dispenser.

The signals emitted by the transmit unit into the surrounding environment of the dispenser may preferably represent information with regard to operating states or control commands.

Dispensing Chamber:

The dispenser for releasing at least one flowable washing and/or cleaning agent preparation into the interior of a domestic appliance may in particular comprise a dispensing chamber which, with the cartridge couplable with the dispenser, is connected in communicating manner with a dispensing chamber inlet located in the dispenser, such that, in the service position of the dispenser, preparation flows in gravity-actuated manner from the cartridge into the dispensing chamber, a dispensing chamber outlet being arranged downstream in the direction of gravity from the dispensing chamber inlet, which dispensing chamber outlet is closable by a valve, a float being arranged in the dispensing chamber, the density of which is lower than the density of the preparation, the float being constructed such that preparation may flow around and/or through the float and the float and the dispensing chamber inlet being configured such that the dispensing chamber inlet is closable by the float.

Depending on the configuration of the density of the preparation and the density of the float and the resultant buoyancy, the float may close the dispensing chamber inlet in sealing or nonsealing manner In the case of a nonsealing closure, while the float does indeed rest against the dispensing chamber inlet, it does not seal the latter with regard to inflow of preparation from the cartridge, such that an exchange of preparation between the cartridge and the dispensing chamber is possible. In this development of the invention, the float acts as a deliberate throttle which, on opening of the valve, minimizes slippage between the dispensing chamber inlet and dispensing chamber outlet and so contributes to determining dispensing accuracy.

Alternatively, the float and the dispensing chamber may be constructed as a self-closing valve, on the one hand, to ensure the lowest possible energy consumption in a dispenser autonomous with regard to energy; on the other hand a defined quantity of preparation which approximately corresponds to the capacity of the dispensing chamber is released.

It is particularly advantageous to select the density of the washing and/or cleaning agent preparation and the density of the float such that the float exhibits a rate of ascent in the washing and/or cleaning agent preparation of 1.5 mm/sec to 25 mm/sec, preferably of 2 mm/sec to 20 mm/sec, particularly preferably of 2.5 mm/sec to 17.5 mm/sec. This ensures sufficiently rapid closure of the dispensing chamber inlet by the ascending float and thus a sufficiently short interval between two instances of dispensing preparation.

The rate of ascent of the float may advantageously also be stored in the valve-actuating control unit of the dispenser. In this way, it is also possible to control the valve in such a manner that a volume of preparation is released which is greater than the volume of the dispensing chamber. In this case, the valve is then reopened before the float reaches its upper closure position against the dispensing chamber inlet and closes the dispensing chamber inlet.

In order to ensure accurate dispensing from the dispensing chamber into the surrounding environment of the dispenser, it has proved advantageous for the float and the dispensing chamber to be configured such that, in the release position of the valve assigned to the dispensing chamber outlet, the rate of ascent of the float in the washing and/or cleaning agent preparation is lower than the rate of flow of the preparation surrounding the float out of the dispensing chamber.

It is preferred to make the float substantially spherical. Alternatively, the float may also be substantially cylindrical.

It is preferable for the dispensing chamber to be substantially cylindrical. It is furthermore advantageous for the diameter of the dispensing chamber to be slightly larger than the diameter of the cylindrical or spherical float, such that slippage with regard to the preparation arises between the dispensing chamber and the float.

According to a development which is to be preferred, the float is formed from a foamed, polymeric material, in particular from foamed PP.

In a further, preferred embodiment, the dispensing chamber is made L-shaped.

Furthermore, a diaphragm may be arranged in the dispensing chamber between the dispensing chamber inlet and dispensing chamber outlet, the diaphragm orifice being constructed such that it may be closed by the float in sealing or nonsealing manner, the float preferably being arranged between the diaphragm and the dispensing chamber inlet.

Component Carrier:

The dispenser comprises a component carrier on which are arranged at least the actuator and the closing element as well as the energy source and/or the control unit and/or the sensor unit and/or the dispensing chamber.

The component carrier comprises receptacles for the stated components and/or the components are shaped in a single part with the component carrier.

The receptacles for the components in the component carrier may be provided for a frictional, interlocking and/or bonded connection between a corresponding component and the corresponding receptacle.

For the purposes of simple demounting of the components from the component carrier, it is furthermore conceivable for the dispensing chamber, the actuator, the closing element, the energy source, the control unit and/or the sensor unit in each case to be detachably arranged on the component carrier.

It is also advantageous for the energy source, the control unit and the sensor unit to be arranged as a combined assembly on or in the component carrier. In an advantageous further development of the invention, the energy source, the control unit and the sensor unit are combined as an assembly. This may for example be achieved by arranging the energy source, the control unit and the sensor unit on a common electrical printed circuit board.

According to a further preferred development of the invention, the component carrier is of a trough-like design and manufactured as an injection molded part. It is particularly preferable for the dispensing chamber to be of single-part construction with the component carrier.

The component carrier ensures maximally straightforward automatic population of the dispenser with the necessary components. The component carrier may in this way be preassembled preferably automatically in its entirety and assembled to form a dispenser.

According to one embodiment of the invention, once populated, the trough-like component carrier may be closed in liquid-tight manner with a, for example, lid-like closing element. The closing element may for example take the form of a film/foil which is bonded in liquid-tight manner with the component carrier and, with the trough-like component carrier, forms one or more liquid-tight chambers.

The closing element may also be a bracket, into which the component carrier may be introduced, in which, when in the assembled state, the bracket and the component carrier form the dispenser. When in the assembled state, the component carrier and the bracket interact such that a liquid-tight connection is formed between the component carrier and the bracket, such that no washing water can get into the interior of the dispenser or of the component carrier.

In the service position of the dispenser, it is furthermore preferred for the receptacle for the actuator on the component carrier to be arranged above the dispensing chamber in the direction of gravity, whereby a compact structure of the dispenser may be achieved. The compact design may be further optimized by arranging the dispensing chamber inlet on the component carrier above the receptacle of the actuator in the service position of the dispenser. It is also to be preferred for the components on the component carrier to be arranged substantially in a row relative to one another, in particular along the longitudinal axis of the component carrier.

In a further development of the invention, the receptacle for the actuator comprises an orifice which is in line with the dispensing chamber outlet, such that a closing element may be moved to and fro by the actuator through the orifice and the dispensing chamber outlet.

It is particularly preferred for the component carrier to be formed of a transparent material.

The component carrier advantageously comprises at least one light guide, through which light from the surrounding environment of the dispenser may be guided into and/or out of the interior(s) of the dispenser or of the component carrier to an optical transmit and/or receive unit, the light guide in particular being shaped in a single-part with the transparent component carrier.

It is accordingly furthermore preferred for at least one orifice to be provided in the dispenser, through which the light from the surrounding environment of the dispenser may be incoupled and/or outcoupled into and/or out of the light guide.

Actuator:

For the purposes of the present application, an actuator is a device which converts an input variable into an output variable of a different kind and with which an object is moved or movement thereof is brought about, the actuator being coupled with at least one closing element such that release of preparation from at least one cartridge chamber may be indirectly or directly effected.

The actuator may be driven by means of drives selected from the group of gravity drives, ion drives, electric drives, motor drives, hydraulic drives, pneumatic drives, gear drives, worm gear drives, ball-screw drives, linear drives, roller-screw drives, toothed worm drives, piezoelectric drives, chain drives, and/or reaction drives.

In particular, the actuator may be constructed from an electric motor which is coupled with a gear train which converts the rotational motion of the motor into a linear motion of a carriage coupled to the gear train. This is in particular advantageous in a slender, plate-shaped configuration of the dispensing unit.

At least one magnet element may be arranged on the actuator, which magnet element, together with a magnet element of identical polarity on a dispenser, effects product release from the container as soon as the two magnet elements are positioned relative to one another such that magnetic repulsion is brought about by the magnetic elements of identical polarity and a contactless release mechanism is created.

In a particularly preferred embodiment of the invention, the actuator is a bistable solenoid which, together with a closing element taking the form of a plunger core engaging in the bistable solenoid, forms a pulse-controlled bistable valve.

Bistable solenoids are electromechanical magnets with a linear direction of motion, the plunger core coming to an unenergized rest in each end position.

Bistable solenoid or valves are known from the prior art. In order to change between valve positions (open/closed), a bistable valve requires a pulse and then remains in this position until a counter-pulse is transmitted to the valve. Such a valve is accordingly also known as a pulse-controlled valve. One substantial advantage of such pulse-controlled valves is that they do not consume any energy in order to remain at the valve end positions, the closure position and the release position, but instead merely require an energy pulse to change valve position and the valve end positions should thus be considered stable. A bistable valve remains in whatever switching position for which it most recently received a control signal.

The closing element (plunger core) is driven to one end position for each pulse of electricity. If the power is switched off, the closing element retains its position. The closing element (plunger core) is driven to the other end position for each pulse of electricity. If the power is switched off, the closing element retains its position.

Bistable characteristics of solenoids may be achieved in various ways. On the one hand, it is known to divide the coil. The coil is divided more or less centrally, so creating a gap. A permanent magnet is inserted into this gap. The plunger core itself has material removed from it by lathe from both front and rear such that, in each end position, it has a planar face relative to the magnet frame. The magnetic field of the permanent magnet flows through this face. The plunger core sticks here. Alternatively, it is also possible to use two separate coils. The principle is similar to the bistable solenoid with a divided coil. The difference is that there actually are two different electrical coils. These are separately driven depending on the direction in which the plunger core is to be moved.

It is thus in particular to be preferred for the closing element to be coupled with the actuator in such a manner that the closing element may be displaced by the actuator into a closure position and into a passage position (release position), the closing element being configured as an open-close valve element, that the actuator is configured such that, driven by a suitable pulse, it adopts as desired one of two end positions and without further drive stably maintains the end position it has reached, and that the combination thus forms a pulse-controlled, bistable open-close valve.

In particular, the actuator may to this end be constructed as a bistable solenoid with a space accommodating an armature and an outer accommodation space surrounding said first space. The armature of the bistable solenoid may be configured such that it forms or is coupled with the closing element.

In order to bring about separation between a wet and a dry space in the dispenser, the actuator space accommodating the armature may be separated from the outer accommodation space of the actuator in liquid-tight and preferably also in gas-tight manner.

It is furthermore advantageous for at least the outer surface of the armature to consist of a material not susceptible to attack by the washing or cleaning agent to be dispensed, in particular of a plastics material.

The armature preferably comprises a core of a magnetizable, in particular a ferromagnetic material, and a permanent magnet positioned in the outer accommodation space, a coil being arranged at each of the two axial ends of said permanent magnet.

It is moreover preferred for the permanent magnets at the axial ends of the armature to be arranged with opposing polarities in the axial direction and for yoke rings of a ferromagnetic material, in particular of iron, to be arranged in the outer accommodation space at both axial ends, with a coil winding arranged between said yoke rings.

It is here advantageous for the axial distance between the yoke rings to be greater than the axial distance between the permanent magnets.

Furthermore, yoke rings may be arranged at the axial ends of the armature, in which in the outer accommodation space permanent magnets are arranged with opposing polarities in the axial direction and between said permanent magnets a coil winding is arranged. The axial distance between the permanent magnets is here preferably greater than the axial distance between the yoke rings.

In particular, an actuator/closing element combination is provided in a dispenser of a dispensing system with a cartridge for flowable washing or cleaning agents with a plurality of chambers for spatially separate accommodation of in each case different preparations of a washing or cleaning agent and with a dispenser couplable with the cartridge, the dispenser comprising: an energy source, a control unit, a sensor unit, an actuator which is connected with the energy source and the control unit in such a manner that a control signal from the control unit brings about actuation of the actuator, a closing element which is coupled with the actuator such that it is displaceable by the actuator into a closure position and into a passage position (release position), at least one dispensing chamber which, in the case of a dispenser assembled with a cartridge, is connected in communicating manner with at least one of the cartridge chambers of the cartridge, the dispensing chamber comprising an inlet for inflow of washing or cleaning agent from a cartridge chamber and an outlet for outflow of washing or cleaning agent from the dispensing chamber into the surrounding environment and at least the outlet of the dispensing chamber being closable or openable by the closing element.

In particular, the actuator is arranged in a component carrier such that, in the service position of the dispenser, a receptacle for the actuator is arranged on the component carrier above the dispensing chamber in the direction of gravity. In the service position of the dispenser, it is here very particularly advantageous for the inlet of the dispensing chamber on the component carrier to be arranged above the receptacle of the actuator.

It is also conceivable for the dispenser to comprise a component carrier in which, in the service position of the dispenser, a receptacle for the actuator is arranged on the component carrier laterally beside the dispensing chamber.

The receptacle for the actuator preferably comprises an orifice which is in line with the outlet of the dispensing chamber, in which the closing element may be moved by the actuator to and fro through the outlet orifice.

Closing Element:

A closing element for the purposes of the present application is a component on which the actuator acts and which, as a consequence of said action, brings about opening or closing of an outlet orifice.

The closing element may, for example, comprise valves which may be adjusted by the actuator into a product release position or a closure position.

It is particularly preferred for the closing element and the actuator to assume the form of a solenoid valve, in which the dispenser is embodied by the valve and the actuator by the electromagnetic or piezoelectric drive of the solenoid valve. In particular when a plurality of containers and thus of preparations to be dispensed are used, the use of solenoid valves permits very precise control of the quantity and timing of dispensing.

It is therefore advantageous to control the release of preparations from each outlet orifice of a chamber with a solenoid valve such that the solenoid valve indirectly or directly determines the release of preparation from the product release orifice.

Sensor:

For the purposes of the present application, a sensor is a measured variable pickup or detecting element, which may qualitatively or quantitatively detect specific physical or chemical properties and/or the material nature of its surrounding environment as a measured variable.

The dispensing unit preferably comprises at least one sensor, which is suitable for detecting a temperature. The temperature sensor is designed in particular to detect a water temperature.

It is additionally preferred for the dispensing unit to comprise a sensor for detecting conductivity, whereby in particular the presence of water or the spraying of water, in particular in a dishwashing machine, is detected.

In a further development of the invention the dispensing unit comprises a sensor, which may determine physical, chemical and/or mechanical parameters from the surrounding environment of the dispensing unit. The sensor unit may comprise one or more active and/or passive sensors for the qualitative and/or quantitative detection of mechanical, electrical, physical and/or chemical variables which are forwarded to the control unit as control signals.

In particular, the sensors of the sensor unit may be selected from the group of timers, temperature sensors, infrared sensors, brightness sensors, temperature sensors, motion sensors, strain sensors, rotational speed sensors, proximity sensors, flow sensors, color sensors, gas sensors, vibration sensors, pressure sensors, conductivity sensors, turbidity sensors, instantaneous acoustic pressure sensors, "lab-on-a-chip" sensors, force sensors, acceleration sensors, inclination sensors, pH sensors, moisture sensors, magnetic field sensors, RFID sensors, magnetic field sensors, Hall sensors, biochips, odor sensors, hydrogen sulfide sensors and/or MEMS sensors.

In particular in the case of preparations whose viscosity is subject to severe temperature-dependent fluctuation, it is advantageous to provide flow sensors in the dispensing device for monitoring the volume or mass of the dispensed preparations. Suitable flow sensors may be selected from the group of diaphragm flow sensors, magnetic-inductive flow meters, mass flow metering using the Coriolis method, eddy flow metering, ultrasound flow metering, rotameter metering, annular piston flow metering, thermal mass flow metering or differential pressure flow metering.

It is particularly preferable for at least two sensor units to be provided for measuring different parameters, one sensor unit very particularly preferably being a conductivity sensor and a further sensor unit very particularly preferably being a temperature sensor. It is additionally preferable for at least one sensor unit to be a brightness sensor.

The sensors are in particular adjusted for detecting the start, progress and end of a washing program. By way of non-exhaustive examples, the sensor combinations listed in the following table may be used for this purpose:

| Sensor 1 | Sensor 2 | Sensor 3 | Sensor 4 |
|---|---|---|---|
| Conductivity sensor | Temperature sensor | | |
| Conductivity sensor | Temperature sensor | Brightness sensor | |

-continued

| Sensor 1 | Sensor 2 | Sensor 3 | Sensor 4 |
|---|---|---|---|
| Conductivity sensor | Temperature sensor | Brightness sensor | Turbidity sensor |
| Acoustic sensor | Temperature sensor | | |

Using the conductivity sensor, it is possible, for example, to detect whether the conductivity sensor has been wetted with water, such that it may for example thereby be established whether there is water in the dishwashing machine.

Washing programs as a rule exhibit a characteristic temperature profile, which is determined inter alia by the heating of the washing water and drying of the items being washed, and which may be detected using a temperature sensor.

A brightness sensor may be used, for example, to detect the incidence of light into the interior of a dishwasher when the dishwashing machine door is opened, from which it may for example be concluded that the washing program has come to an end.

A turbidity sensor may also be provided to determine the degree of soiling of the items to be washed in the dishwasher. This for example also allows selection of a dispenser dispensing program which is appropriate for the identified soiling situation.

It is also feasible to detect the progress of a washing program with the assistance of at least one acoustic sensor, specific sound and/or vibration emissions being detected, for example when water is pumped in or out.

It goes without saying that it is possible for a person skilled in the art to use any desired, suitable combinations of a number of sensors to achieve washing program monitoring.

According to a further development of the invention, it is conceivable for a temperature-dependent viscosity curve of at least one preparation to be saved in the control unit, with dispensing being adjusted by the control unit in accordance with the temperature and thus the viscosity of the preparation.

In a further development of the invention, a device is provided for directly determining the viscosity of the preparation.

The previously listed alternatives for determining the dispensing amount or viscosity of a preparation serve to generate a control signal which is processed by the control unit in such a manner for controlling a dispenser that substantially constant dispensing of a preparation is brought about.

The data line between sensor and control unit may take the form of an electrically conductive cable or may assume a cable-less form. In principle it is also conceivable for at least one sensor to be positioned or positionable outside the dispenser in the interior of a dishwashing machine and for a data line, in particular a cable-less data line, to be provided for transmitting measured data from the sensor to the dispenser.

A cable-less data line is achieved in particular by the transmission of electromagnetic waves or light. It is preferable for a cable-less data line to be configured to standards such as for example Bluetooth, IrDA, IEEE 802, GSM, UMTS etc.

To allow efficient production and assembly of the dispenser, it is also possible, however, for at least one sensor unit to be arranged on or in the control unit. For example, it is possible to provide a temperature sensor in the dispenser or directly on the board bearing the control unit, such that the temperature sensor does not have any direct contact with the surrounding environment.

In a particularly preferred development of the invention the sensor unit is arranged at the bottom of the dispenser, the bottom of the dispenser in the service position being directed downwards in the direction of gravity. It is particularly preferable here for the sensor unit to comprise a temperature and/or a conductivity sensor. Such a configuration ensures that, through the spray arms of the dishwasher, water reaches the underside of the dispenser and thus comes into contact with the sensor. Because the arrangement of the sensor on the bottom ensures that the distance between the spray arms and the sensor is as small as possible, between discharge at the spray arms and contact with the sensor the water undergoes only slight cooling, such that the temperature may be measured as accurately as possible.

To extend the dispenser's energy consumption or the service life of the energy source, the dispenser's energy consumers, in particular the control unit, may be connected to the energy source with the inclusion of an on-off switch and the energy source is subjected to load only once the on state of the on-off switch is reached, a sensor unit forming the on-off switch or being connected therewith and switching the latter.

It is particularly preferred for the sensor unit underneath on the bottom of the dispenser to comprise two contacts in contact with the surrounding environment, these in particular taking the form of contact pins projecting downwards from the bottom, for one contact to be connected relative to the energy source as an anode contact and for the other contact to be connected as a cathode contact and for the on-off switch in the off state to remain in the off state if there is no electrically conductive connection between the contacts and for the on-off switch in the off state to be switched to the on state when an electrically conductive connection arises between the contacts.

It is furthermore preferred for the on-off switch to be provided or combined with a seal-in circuit, which ensures or brings about sealing in of the energy supply of the energy consumers once the on state of the on-off switch is reached until the control unit outputs an off signal.

The on-off switch may take the form in particular of a transistor circuit. In this case it is preferable for the transistor of the on-off switch to take the form of a PNP transistor and to be connected with the emitter, optionally via a drive circuit, to the supply voltage, with the collector, optionally via a drive circuit, to ground and to the cathode contact and with the base on the one hand, optionally via a drive circuit, to the supply voltage and on the other hand, optionally via a drive circuit, to the anode contact.

The drive circuit preferably comprises at least one drive resistor, which takes the form in particular of a resistance voltage divider.

It is very particularly advantageous for a sensor unit in the form of a conductivity sensor to be provided in addition to the on-off sensor unit, the sensor unit in the form of a conductivity sensor comprising two contacts underneath on the bottom of the dispenser in contact with the surrounding environment, and for the anode contact of the on-off sensor unit simultaneously to be the anode contact of the sensor unit forming the conductivity sensor. This makes it possible to embody an on-off switch and a conductivity sensor as a single component, a transistor.

It is also possible for the sensor unit forming the temperature sensor to be integrated into a contact, in particular the cathode contact, of the sensor unit forming the conductivity sensor.

The contact, accommodating the temperature sensor, of the sensor unit forming the conductivity sensor may here preferably take the form of a hollow contact pin, in which the temperature sensor of the sensor unit forming the temperature sensor is arranged.

To achieve a compact structural size it is additionally advantageous for the energy source, the control unit and the sensor unit to be combined into an assembly on or in the component carrier.

It is particularly preferable for the contacts of a conductivity sensor arranged on the bottom to be surrounded by an electrically conductive silicone. The conductivity sensor may here take the form in particular of a resistance measurement between two mutually spaced contacts in contact with the surrounding environment of the dispenser. It is in this case very particularly preferable for the silicone to be set flush into the bottom of the dispenser. Advantageously, the silicone comprises an approximately circular base area. The silicone displays good wettability with water and thus supplies good measurement results with regard to the detection of water in the dishwasher.

In order to avoid polarization at the contacts of the conductivity sensor when a direct current source is used, which impairs sensor accuracy, it is advantageous to carry out two successive resistance measurements at the conductivity sensor with in each case different polarities, i.e. with reversal of the plus and minus poles, such that no charge excesses can form at the contacts.

Control Unit:

A control unit for the purposes of the present application is a device which is suitable for influencing the transport of material, energy and/or information. To this end, the control unit acts on actuators with the assistance of information, in particular sensor unit measurement signals, which it processes for the purposes of the control objective.

The control unit may in particular comprise a programmable microprocessor. In a particularly preferred embodiment of the invention, a plurality of dispensing programs are stored in the microprocessor which in a particularly preferred configuration may be selected and executed depending on the container coupled to the dispenser.

In a preferred embodiment, the control unit is not connected to any controller which may be present in the domestic appliance. Accordingly, no information, in particular electrical, optical or electromagnetic signals, is exchanged directly between the control unit and the controller of the domestic appliance.

In an alternative development of the invention the control unit is coupled to the existing controller of the domestic appliance. This coupling is preferably cable-less. It is possible, for example, to position a transmitter on or in a dishwashing machine, preferably on or at the dispensing chamber set into the door of the dishwashing machine, which transmits a signal wirelessly to the dispensing unit if the controller of the domestic appliance brings about dispensing for example of a cleaning agent from the dispensing chamber or of rinse aid.

A plurality of programs for the release of different preparations or for the release of products in different instances of use may be stored in the control unit.

In a preferred development of the invention, the appropriate program is called by corresponding RFID labels or geometric information media formed on the container. It is thus for example possible to use the same control unit for a plurality of applications, for example for dispensing cleaning agents in dishwashing machines, for releasing perfumes for room fragrancing, for applying cleaning substances to a toilet bowl etc.

In order to dispense preparations which in particular have a tendency towards gelation, the control unit may be configured in such a way that on the one hand dispensing takes place in a sufficiently short time to ensure a good cleaning result and on the other hand the preparation is not dispensed so quickly that the spurt of preparation gels. This may be effected for example by release at intervals, the individual dispensing intervals being adjusted in such a way that the correspondingly dispensed quantities dissolve completely during a cleaning cycle.

It is particularly preferable for the dispensing intervals for releasing a preparation to be between 30-90 sec, particularly preferably 45-75 sec.

Release of preparations from the dispenser may proceed in sequence or at the same time.

It is particularly preferable to dispense a plurality of preparations in sequence in a washing program. The following dispensing sequences are particularly preferable:

| 1st dispensing | 2nd dispensing | 3rd dispensing | 4th dispensing |
|---|---|---|---|
| Enzymatic cleaning preparation | Alkaline cleaning preparation | | |
| Alkaline cleaning preparation | Rinse aid | | |
| Enzymatic cleaning preparation | Alkaline cleaning preparation | Rinse aid | |
| Enzymatic cleaning preparation | Alkaline cleaning preparation | Rinse aid | Disinfectant preparation |
| Enzymatic cleaning preparation | Alkaline cleaning preparation | Rinse aid | Scent |
| Pretreatment preparation | Enzymatic cleaning preparation | Alkaline cleaning preparation | Rinse aid |

According to a particularly preferred embodiment of the invention, the dishwashing machine and the dispenser interact in such a way that 1 mg to 1 g of surfactant are released in the rinse program of the dishwashing machine per $m^2$ of washing compartment wall area. In this way it is ensured that the walls of the washing compartment retain their degree of gloss even after a large number of washing cycles and the dispensing system retains its optical transmission capacity.

It is additionally advantageous for the dishwashing machine and the dispenser to interact in such a way that in the prewash and/or main wash program of the dishwashing machine at least one enzyme-containing preparation and/or alkaline preparation is released, the enzyme-containing preparation preferably being released before the alkaline preparation.

In a further, advantageous development of the invention, the dishwashing machine and dispenser interact in such a way that 0.1 mg-250 mg of enzyme protein are released in the prewash and/or main wash program of the dishwashing machine per $m^2$ of washing compartment wall area, whereby the degree of gloss of the washing compartment walls is further improved or is maintained even after a plurality of washing cycles.

In an advantageous further development of the invention, data such as for example control and/or dispensing programs of the control unit or operating parameters or protocols stored by the control unit may be read out of the control unit or loaded into the control unit. This may be performed for example by means of an optical interface, the optical interface being connected appropriately to the control unit. The data to be transmitted are then encoded as light signals, in particular in the visible range, the wavelength range between 600-800 nm being preferred, and emitted or received. It is also possible, however, to use a sensor present in the dispenser for transmitting data from and/or to the control unit. For example, the contacts of a conductivity sensor, which are connected to the control unit and which provides conductivity determination by means of resistance measurement at the contacts of the conductivity sensor, are used for data transmission.

Energy Source:

For the purposes of the present application, an energy source is taken to mean a component of the dispensing device which is capable of providing energy which is suitable for operation of the dispensing system or of the dispenser. The energy source is preferably configured such that the dispensing system is autonomous.

The energy source preferably provides electrical energy. The energy source may for example comprise a battery, a storage battery, a mains energy supply, solar cells or the like.

It is particularly advantageous to make the energy source interchangeable, for example in the form of a replaceable battery.

A battery may for example be selected from the group of alkali-manganese batteries, zinc-carbon batteries, nickel-oxyhydroxide batteries, lithium batteries, lithium-iron sulfide batteries, zinc-air batteries, zinc chloride batteries, mercury oxide-zinc batteries and/or silver oxide-zinc batteries.

Examples of suitable storage batteries are lead storage batteries (lead dioxide/lead), nickel-cadmium storage batteries, nickel-metal hydride storage batteries, lithium-ion storage batteries, lithium-polymer storage batteries, alkali-manganese storage batteries, silver-zinc storage batteries, nickel-hydrogen storage batteries, zinc-bromine storage batteries, sodium-nickel chloride storage batteries and/or nickel-iron storage batteries.

The storage battery may in particular be designed in such a way that it is rechargeable by induction.

It is however also conceivable to provide mechanical energy sources consisting of one or more helical springs, torsion springs or torsion bars, bending springs, air/gas springs and/or elastomer springs.

The energy source is dimensioned in such a manner that the dispenser may run through approximately 300 dispensing cycles before the energy source is exhausted. It is particularly preferable for the energy source to run through between 1 and 300 dispensing cycles, very particularly preferably between 10 and 300, more preferably between 100 and 300, before the energy source is exhausted.

In addition, means may be provided on the dispensing unit for energy conversion, which generate a voltage by means of which the storage battery is charged. These means may for example take the form of a dynamo, which is driven by the water currents during a washing cycle in a dishwashing machine and outputs the voltage generated in this way to the storage battery.

Light Guide, Dispenser:

An optical transmit and/or receive unit is preferably arranged inside the dispenser, in particular in or on the component carrier, in order to protect the electrical and/or optical components of the transmit and/or receive unit from being affected by water splashes and washing water.

To conduct light out of the surrounding environment of the dispenser to the optical transmit and/or receive unit, a light guide is arranged between the optical transmit and/or receive unit and the surrounding environment of the dispenser, which exhibits light transmittance of at least 75%. The light guide preferably consists of a transparent plastics material with a transmittance of at least 75%. The transmittance of the light guide is defined as transmittance between the surface of the light guide at which light is incoupled from the surrounding environment of the dispenser into the light guide and the surface at which light is outcoupled from the light guide to the optical transmit and/or receive unit. Transmittance may be determined to DIN 5036.

The light guide comprises at least one incoupling and/or outcoupling point at which light from an optical transmit and/or receive unit and/or from the surrounding environment of the dispenser is respectively incoupled and outcoupled.

It is particularly preferable for the light guide to be of single-part construction with the component carrier. Advantageously, the component carrier is therefore made from a transparent material.

To accommodate the incoupling and/or outcoupling point of the light guide and produce an optical connection between light guide and surrounding environment, an orifice is provided in the dispenser. The incoupling and/or outcoupling point may be arranged in the outer circumferential surface in the bottom or top of the dispenser. In order to provide a good transmit and/or receive characteristic for optical signals, it may be advantageous for the incoupling and/or outcoupling point of the light guide to be of lenticular and/or prismatic construction.

The light guide may also be of multilayer and/or multipart construction of identical or different materials. It is also possible to provide an air gap between a light guide of multilayer and/or multipart form. The transmittance of the light guide is understood in the case of a multilayer and/or multipart structure as being between the surface of the light guide at which light is incoupled from the surrounding environment of the dispenser into the light guide and the surface at which light is outcoupled from the light guide to the optical transmit and/or receive unit.

In addition, it is preferable for at least two incoupling or outcoupling points of the light guide to be provided relative to the surrounding environment. It is particularly advantageous for the incoupling or outcoupling points on the dispenser to be substantially opposite one another.

The invention is illustrated in greater detail below with reference to drawings which represent merely exemplary embodiments. Particularly preferred developments and particularly preferred combinations of features are also further described in detail. In the Figures the following reference signs correspond to the following elements:

LIST OF REFERENCE SIGNS

1 Cartridge
2 Dispenser
3 Chamber
4 Cartridge bottom
5 Outlet orifice
6 Half shell-shaped element
7 Half shell-shaped element
8 Connecting edge
9 Separating web
10 Cartridge top
11 Cartridge side face
12 Cartridge side face
13 Cartridge front wall
14 Cartridge back wall
15 Energy source
16 Control unit
17 Sensor unit
18 Actuator
19 Closing element
20 Dispensing chamber

21 Dispensing chamber inlet
22 Dispensing chamber outlet
23 Component carrier
24 Rubber grommet
25 Equalizing disk
26 Predispensing chamber
27 Outlet chamber
28 Receptacle
29 Receptacle
30 Connecting port
31 Chamber wall
32 Channel
33 Channel
34 Orifice
35 Seal
36 Seal
37 Indicator and operating elements
38 Dishwashing machine
39 Dishwashing machine door
40 Preparation
41 Crockery drawer
42 Adapter
43 Recess
44 Retaining elements
45 Chamber
46 Orifice
47 Interface
48 Interface
49 Orifice
50 Adapter
51 Refill cartridge
52 Chamber
53 Dispensing chamber
54 Bracket
55 Hinge
56 Hook
57 Permanent magnet
58 Coil
59 Coil
60 Retention point
61 Retention point
62 Bottom
63 Channel
64 Pouch
65 Orifice
66 Material bridge
67 High pressure cleaner
68 Cleaning robot
69 Fitting
70 Vehicle
71 Water tank
72 Pump
73 Nozzle
74 Steam iron
75 Plant watering system
76 Sensor
77 Adapter
78 Water inlet
79 Water outlet
80 Seal FIG. 1 shows an autonomous dispenser 2 with a two-chamber cartridge 1 in the separated and assembled states. The dispenser 2 comprises two dispensing chamber inlets 21*a*, 21*b* for repeatedly detachable accommodation of the corresponding outlet orifices 5*a*, 5*b* of the chambers 3*a*, 3*b* of the cartridge 1. Indicator and operating elements 37, which indicate the operating state of the dispenser 2 or have an effect thereon, are located on the front.

The dispensing chamber inlets 21*a*, 21*b* additionally comprise means which, when the cartridge 1 is placed on the dispenser 2, bring about opening of the outlet orifices 5*a*, 5*b* of the chambers 3*a*, 3*b*, such that the interior of the chambers 3*a*, 3*b* is connected in communicating manner to the dispensing chamber inlets 21*a*, 21*b*.

The cartridge 1 may consist of one or more chambers 3*a*, 3*b*. The cartridge 1 may be of single-part construction comprising a plurality of chambers 3*a*, 3*b* or be of multipart construction, the individual chambers 3*a*, 3*b* then being assembled to form a cartridge 1, in particular by bonded, interlocking or frictional connection methods.

In particular, fixing may be effected by one or more of the connection types from the group of snap-in connections, press connections, melt connections, adhesive connections, welded connections, brazed connections, screw connections, keyed connections, clamped connections or rebound connections. In particular, fixing may also be provided by a heat-shrinkable sleeve, which is drawn in the heated state over at least portions of the cartridge and firmly envelops the cartridge in the cooled state.

The bottom of the cartridge 1 may be inclined in the manner of a funnel towards the release orifice 5*a*, 5*b* in order to provide the cartridge 1 with advantageous residual emptying characteristics. Moreover, the internal wall of the cartridge 1 may be constructed by suitable material selection and/or surface finish such that the product adheres only slightly to the internal wall of the cartridge. The residual emptying characteristics of the cartridge 1 may also be further optimized by this measure.

The chambers 3*a*, 3*b* of the cartridge 1 may be of identical or different capacities. In a configuration with two chambers 3*a*, 3*b*, the ratio of the chamber volumes is preferably 5:1; in a configuration with three chambers preferably 4:1:1, these configurations in particular being suitable for use in dishwashing machines.

One possible connection method may also consist in plugging the chambers 3*a*, 3*b* into one of the corresponding dispensing chamber inlets 21*a*, 21*b* of the dispenser 2 and thereby fixing them relative to one another.

The connection between the chambers 3*a*, 3*b* may in particular be detachable, so as to allow separate replacement of chambers.

The chambers 3*a*, 3*b* each contain a preparation 40*a*, 40*b*. The preparation 40*a*, 40*b* may be of the same or different composition.

Advantageously, the chambers 3*a*, 3*b* are made of a transparent material, such that the filling level of the preparations 40*a*, 40*b* is visible to the user from outside. It may however also be advantageous to make at least one of the chambers from an opaque material, in particular when the preparation located in this chamber contains light-sensitive ingredients.

The outlet orifices 5*a*, 5*b* are designed such that they form an interlocking and/or frictional, in particular liquid-tight, connection with the corresponding dispensing chamber inlets 21*a*, 21*b*.

It is particularly advantageous for each of the outlet orifices 5*a*, 5*b* to be configured such that it fits onto only one of the dispensing chamber inlets 21*a*, 21*b*, so preventing a chamber from being inadvertently plugged onto an incorrect dispensing chamber inlet.

The cartridge 1 conventionally has a capacity of <5000 ml, in particular <1000 ml, preferably <500 ml, particularly preferably <250 ml, very particularly preferably <50 ml.

In the assembled state, the dispensing unit 2 and the cartridge 1 may be adapted in particular to the geometries of the devices on or in which they are used, so as to ensure the smallest possible loss in useful volume. To use the dispensing unit 2 and the cartridge 1 in dishwashing machines it is particularly advantageous to shape the dispensing unit 2 and the cartridge 1 in imitation of dishes to be cleaned in dishwashing machines. The dispensing unit 2 and the cartridge 1 may, for example, be plate-shaped, approximately assuming the dimensions of a plate. In this way, the dispensing unit may be positioned in space-saving manner in the lower basket.

In order to provide direct visual checking of filling level, it is advantageous to form the cartridge 1 at least in portions of a transparent material.

In order to protect heat-sensitive components of a product present in a cartridge from exposure to heat, it is advantageous to produce the cartridge 1 from a material with low thermal conductivity.

The outlet orifices 5*a*, 5*b* of the cartridge 1 are preferably arranged in a line or row, so making a slender, plate-shaped configuration of the dispenser possible.

Figure 2:
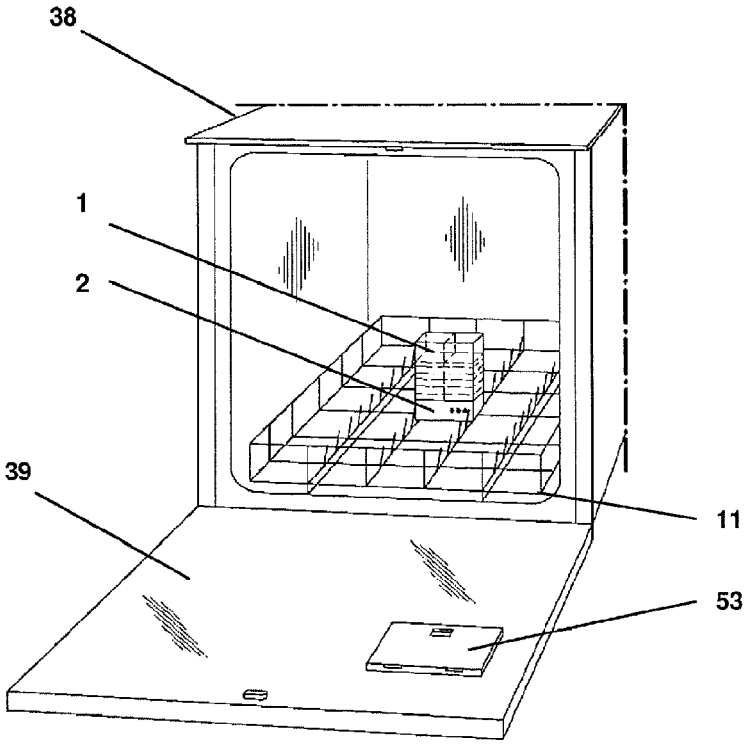
FIG. 2 is a perspective view of an autonomous dispenser with two-chamber cartridge arranged in a drawer of a dishwashing machine according to an embodiment of the present invention.

FIG. 2 shows an autonomous dispenser with a two-chamber cartridge 1 in the crockery drawer 11 when the door 39 of a dishwashing machine 38 is open.

Figure 3:
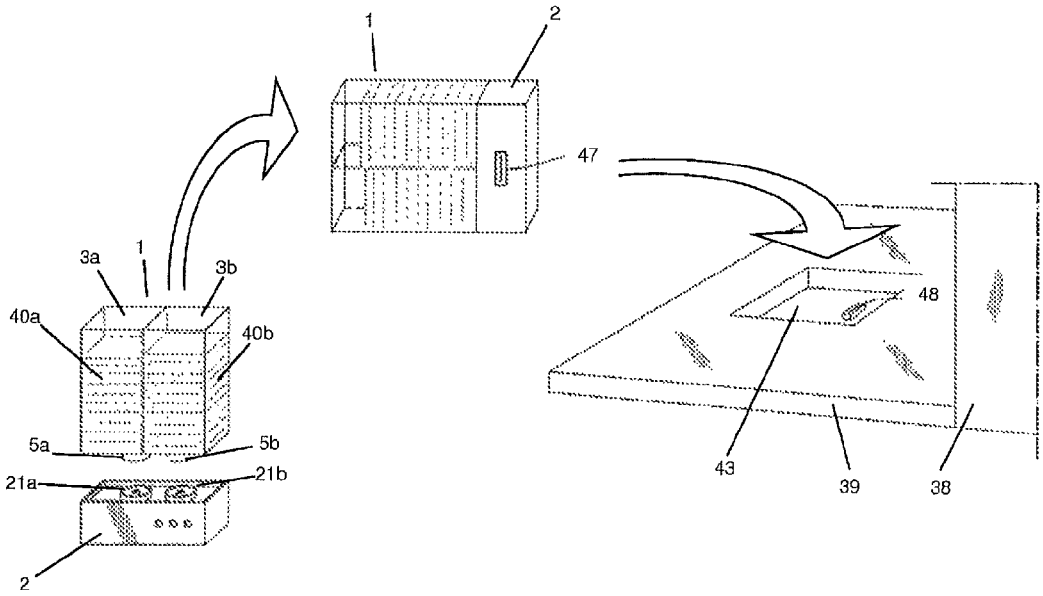
FIG. 3 is a diagram depicting the assembly and integration of an autonomous dispenser into a dishwashing machine according to an embodiment of the present invention.
Figure 4:
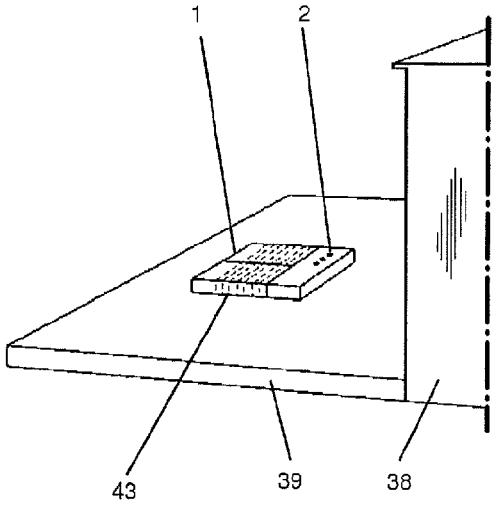
FIG. 4 is a rear perspective view of a dishwashing machine that includes a two-chamber cartridge assembled and integrated therein according to an embodiment of the present invention.

A further development of the invention is shown in FIG. 3. The dispenser 2 may here be coupled to the cartridge 1, this being indicated accordingly in the drawing by the first, left-hand arrow. Then, cartridge 1 and dispenser 2 are coupled as an assembly via the interface 47, 48 to the dishwasher, as shown by the right-hand arrow. The dispenser 2 comprises an interface 47, via which data and/or energy are transmitted to and/or from the dispenser 2. In the door 39 of the dishwasher 38 a recess 43 is provided for accommodating the dispenser 2. In the recess 43 a second interface 48 is provided, which transmits data and/or energy to and/or from the dispenser 2.

Preferably, data and/or energy are exchanged wirelessly between the first interface 47 on the dispenser 2 and the second interface 48 on the dishwasher 38. It is particularly preferable for energy to be transmitted from the interface 48 of the dishwasher 38 wirelessly via the interface 47 to the dispenser 2. This may, for example, proceed inductively and/or capacitively.

It is furthermore advantageous for the interface for data transmission also to be of wireless configuration. This may be achieved using the methods known in the prior art for wireless data transmission, such as for example by means of radio transmission or IR transmission.

Alternatively, the interfaces 47, 48 may also take the form of integral plug-in connections. Advantageously, the plug-in connections are configured in such a way that they are protected from the ingress of water or moisture.

Figure 5:
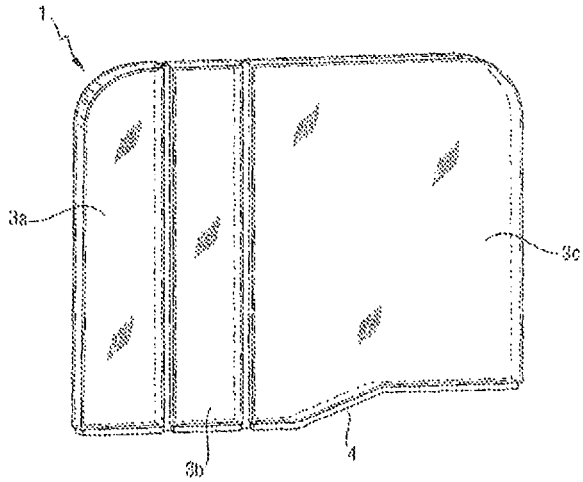
FIG. 5 is a front view of a dispenser cartridge having three chambers according to an embodiment of the present invention.

FIG. 5 shows a further possible embodiment of the cartridge 1 with three chambers 3*a*, 3*b*, 3*c*. The first chamber 3*a* and the second chamber 3*b* have approximately the same capacity. The third chamber 3*c* has a capacity which is for instance 5 times that of chamber 3*a* or 3*b*. The cartridge bottom 4 comprises a ramp-shaped step in the region of the third chamber 3*c*. This asymmetric configuration of the cartridge 1 makes it possible to ensure that the cartridge 1 is couplable to the dispenser 2 in a position intended therefor and insertion in an incorrect position is prevented by a corresponding configuration of the dispenser 2 or the bracket 54.

Figure 6:
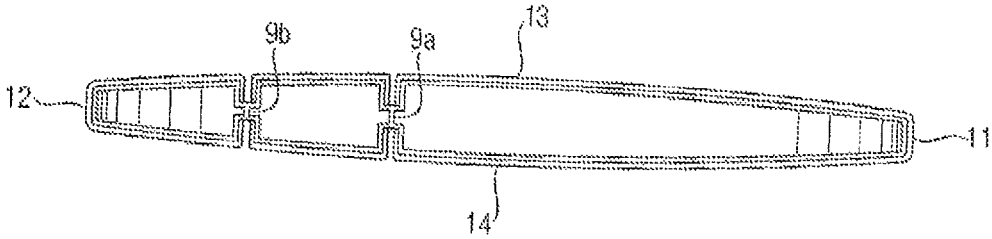
FIG. 6 is a plan view of the dispenser cartridge depicted in FIG. 5.

The plan view of the cartridge shown in FIG. 6 shows the separating webs 9*a* and 9*b*, which separate the chambers of the cartridge 1 from one another. The cartridge known from FIG. 5 and FIG. 6 may be formed in various ways.

Figure 7:
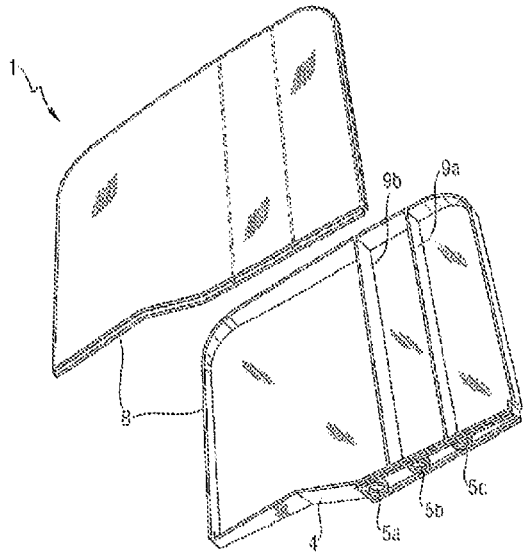
FIG. 7 is an exploded view of a two-part cartridge with a trough-shaped and a plate-like cartridge element according to an embodiment of the present invention.

In a first variant, which may be inferred from FIG. 7, the cartridge 1 is formed of a first trough-like cartridge element 7 and a second, lid- or plate-like cartridge element 6. The separating webs 9*a* and 9*b* are provided in the trough-like cartridge element 7 and form the three chambers of the cartridge 1. On the bottom 4 of the trough-shaped cartridge element 7 the outlet orifices 5*a*, 5*b*, 5*c* are arranged in each case under the chambers of the cartridge 1.

As is additionally clear from FIG. 7, the bottom 4 of the cartridge in the region of the third chamber 3*c* comprises a ramp-like step, which forms a slope on the chamber bottom in the direction of the third outlet orifice 5*c*. In this way, it is ensured that preparation located in this chamber 3*c* is always conveyed in the direction of the outlet orifice 5*c* and thus good residual emptying characteristics of the chamber 3*c* are achieved.

When the cartridge 1 is assembled, the trough-shaped cartridge element 7 and the lid-like cartridge element 6 are bonded together along the common connecting edge 8. This may be achieved for example by welding or adhesive bonding. It goes without saying that, when the cartridge 1 is assembled, the webs 9*a*, 9*b* are also bonded to the cartridge element 6.

The connecting edge 8 does not here run through the outlet orifices 5*a-c*, so avoiding leakage problems in the region of the orifices 5*a-c*, in particular in the state coupled to the dispenser.

Figure 8:
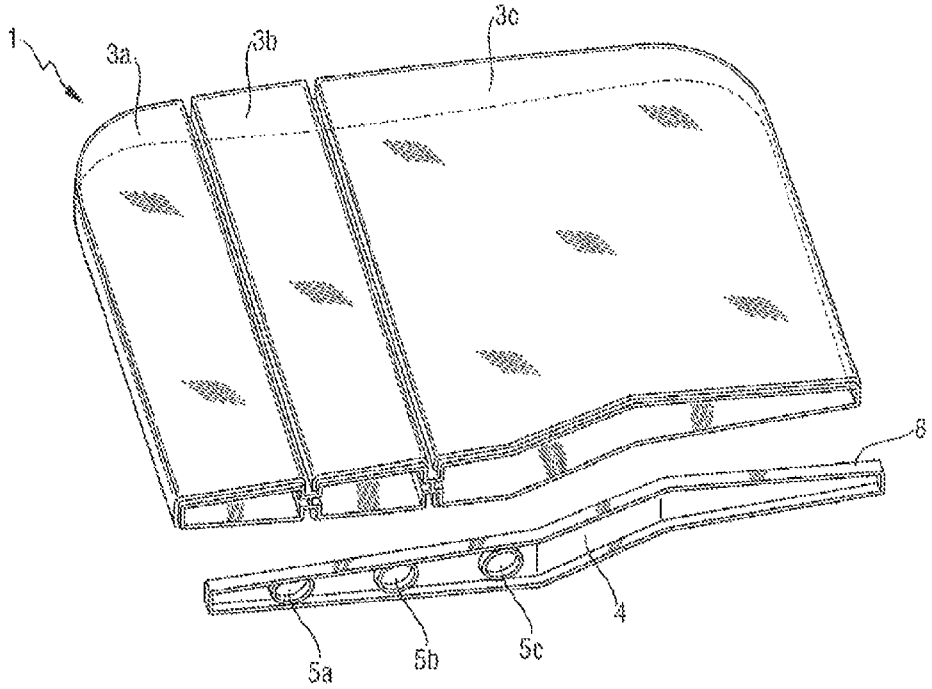
FIG. 8 is an exploded view of a two-part cartridge with a cellular container and a cartridge bottom according to an embodiment of the present invention.

A further variant for embodying the cartridge is shown in FIG. 8. The first cartridge element 6 is here of cellular construction and comprises an open bottom. The separately formed bottom 4 may be inserted as a second cartridge element 7 into the orifice at the bottom of the cellular cartridge element 6 and bonded thereto along the common connecting edge 8. An advantage of this variant is that the cellular element 6 may be produced inexpensively by a plastics blow molding method.

Figure 9:
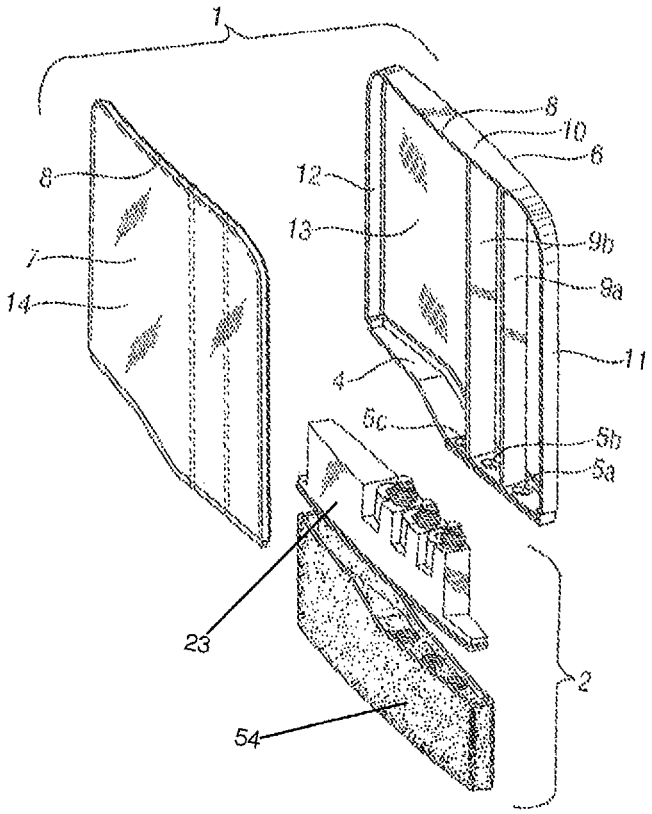
FIG. 9 is an exploded view of a dispenser and a cartridge according to an embodiment of the present invention.

FIG. 9 is an exploded representation of the essential components of the dispensing system consisting of cartridge 1 and dispenser 2.

As may be inferred from FIG. 9, the cartridge 1 is composed of two cartridge elements 6, 7, which are already known from FIG. 7. The dispenser 2 consists substantially of a component carrier 23 and a bracket 54, in which the component carrier 23 may be inserted.

Figure 10:
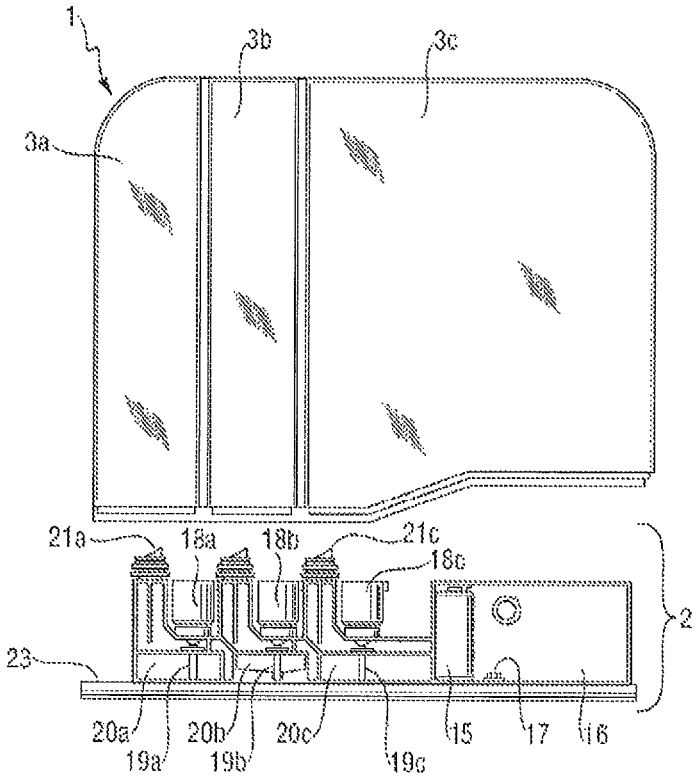
FIG. 10 is a front view of a component carrier and a cartridge according to an embodiment of the present invention.

FIG. 10 shows a side view onto the component carrier 23 of the dispenser 2, which is explained in greater detail below.

The dispensing chamber 20, the actuator 18 and the closing element 19 are arranged on the component carrier 23, as are also the energy source 15, the control unit 16 and the sensor unit 17. The dispensing chamber 20, the predispensing chamber 26, the dispensing chamber inlet 21 and the receptacle 29 are formed in a single part with the component carrier 23.

As may also be inferred from FIG. 10, the energy source 15, the control unit 16 and the sensor unit 17 are combined in an assembly by arranging them on a corresponding board.

Figure 23:
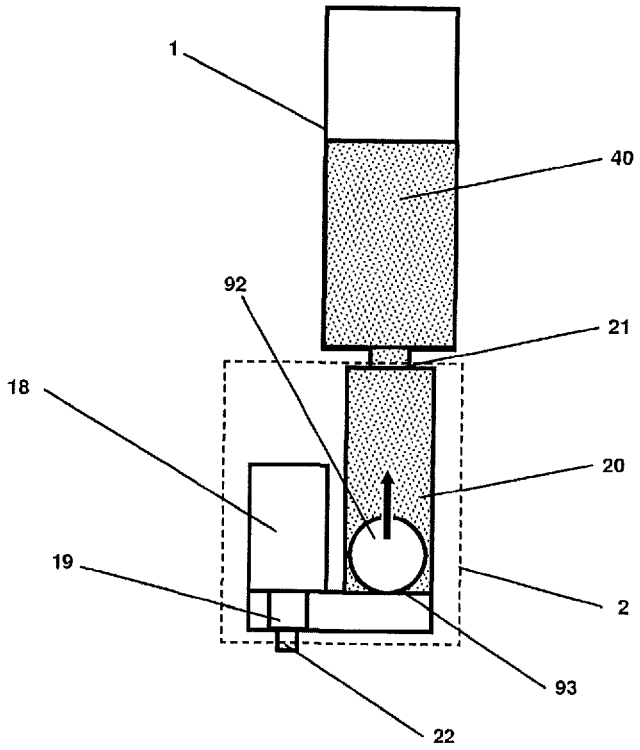

As shown in FIG. 23, the predispensing chamber 26 and the actuator 18 are arranged substantially next to one another on the component carrier 23. The predispensing chamber 26 has an L-shaped basic shape with a shoulder in the lower region, into which is set the receptacle 29 for the actuator 18. The outlet chamber 27 is arranged beneath the predispensing chamber 26 and the actuator 18. The predispensing chamber 26 and the outlet chamber 27 together form the dispensing chamber 20.

The predispensing chamber 26 and the outlet chamber 27 are connected together by the orifice 34.

The receptacle 29, the orifice 34 and the dispensing chamber outlet 22 lie in a row perpendicular to the longitudinal axis of the component carrier 23, such that the rod-shaped closing element 19 may be guided through the orifices 22, 29, 34.

Figure 11:
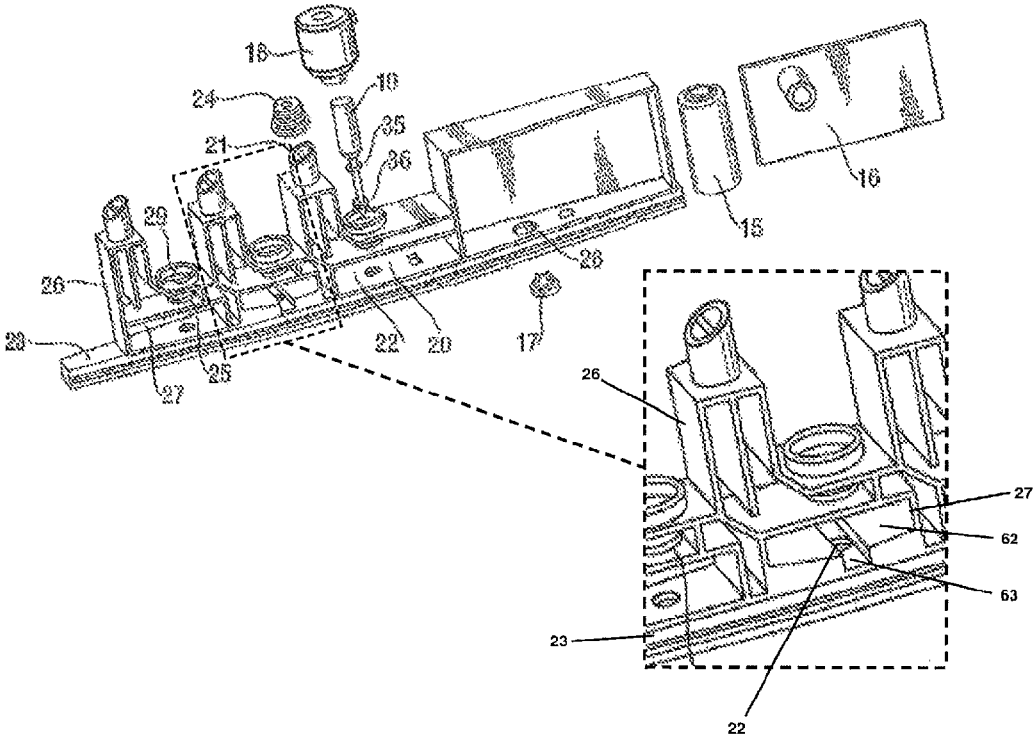
FIG. 11 is an exploded view of a component carrier according to an embodiment of the present invention.

As is apparent in particular from FIG. 11, the rear walls of the predispensing chamber 26 and the outlet chamber 27 are formed integrally with the component carrier 23. The front wall may then for example be bonded to the dispensing chamber 20 for example by a covering element or a film/foil (not shown).

The configuration of the dispensing chamber 20 is explained in greater detail with reference to the detailed view of FIG. 11. This figure shows the outlet chamber 27, which has a bottom 62. The bottom 62 is inclined in the manner of a funnel towards the dispensing chamber outlet 22 arranged centrally in the outlet chamber 27. The dispensing chamber outlet 22 is located in a channel 63, which extends at right angles to the longitudinal axis of the component carrier 23 in the outlet chamber 27. The funnel-shaped bottom 62 and the channel 63 and the outlet orifice 22 arranged therein ensure dispensing and virtually complete residual emptying of preparation out of the dispensing chamber 20 if the dispenser is in a position other than horizontal. Furthermore, as a result of the correspondingly funnel-shaped bottom the preparation flows more quickly out of the dispensing chamber, in particular in the case of relatively high viscosity preparations, such that the dispensing period, in which preparation is released, may be kept short.

In FIG. 11 only the middle dispensing chamber 20 is provided with a funnel-shaped bottom of the above-described type. It goes without saying that, in contrast to this representation, further or all of the dispensing chambers may be so shaped. This also applies to the predispensing chambers 26 and outlet chambers 27, if these are provided.

The arrangement of the actuator 18, of the closing element 19 and of the seal 36 on the component carrier 23 is explained in greater detail with reference to the exploded representation in FIG. 12. The figure shows a component carrier 23 with three dispensing chambers 20 arranged next to one another. In the dispensing chamber on the far right the actuator 18*c*, the closing element 19*c* and the seal 36*c* are shown in the assembled state on the component carrier 23. In the case of the middle dispensing chamber the seal 36*b* and the closing element 19*b* are shown in the assembled state in the dispensing chamber, while the actuator 18*b* has been detached from the closing element 19*b*. Above the left-hand dispensing chamber 20*a* the seal 36*a*, the closing element 19*a* and also the actuator 18*a* are shown in an exploded representation.

The dispensing chamber 20, the predispensing chamber 26, the dispensing chamber inlet 21 and the receptacle 29 for the actuator 18 are of integral construction with the component carrier 23. The predispensing chamber 26 is arranged in an L-shape above the dispensing chamber 20, the receptacle for the actuator 18 being arranged on the leg of the predispensing chamber extending parallel to the bottom of the component carrier 23. The dispensing chamber 20 and the predispensing chamber 26 are connected together by the orifice 34. The receptacle 29, the orifice 34 and the dispensing chamber outlet 22 lie on an axis, which extends perpendicularly to the longitudinal axis of the component carrier 23.

The seal 36 has a substantially hollow-cylindrical configuration, with a top closed by a plate-like end piece. The resilient seal 36 may be arranged in the dispensing chamber 20 in such a way that the plate-like end piece presses on the inside against the dispensing chamber outlet 22 and with the side of the seal 36 remote from the plate-like end piece against the orifice 34. The first end of the cylindrical closing element 19 is constructed in such a way that it engages in the hollow-cylindrical seal 36 and may be fixed there by interlocking, friction and/or bonding. The closing element 19 is dimensioned such that it may be passed through the orifice 34 and the orifice of the receptacle 29, but abuts against the dispensing chamber outlet 22, such that the closing element 19 cannot slip downwards out of the component carrier 23.

The closing element 19 projects with one end out of the receptacle 29. This end is inserted into the actuator 18 constructed as a bistable electromagnet and functions as an armature.

Figure 12:
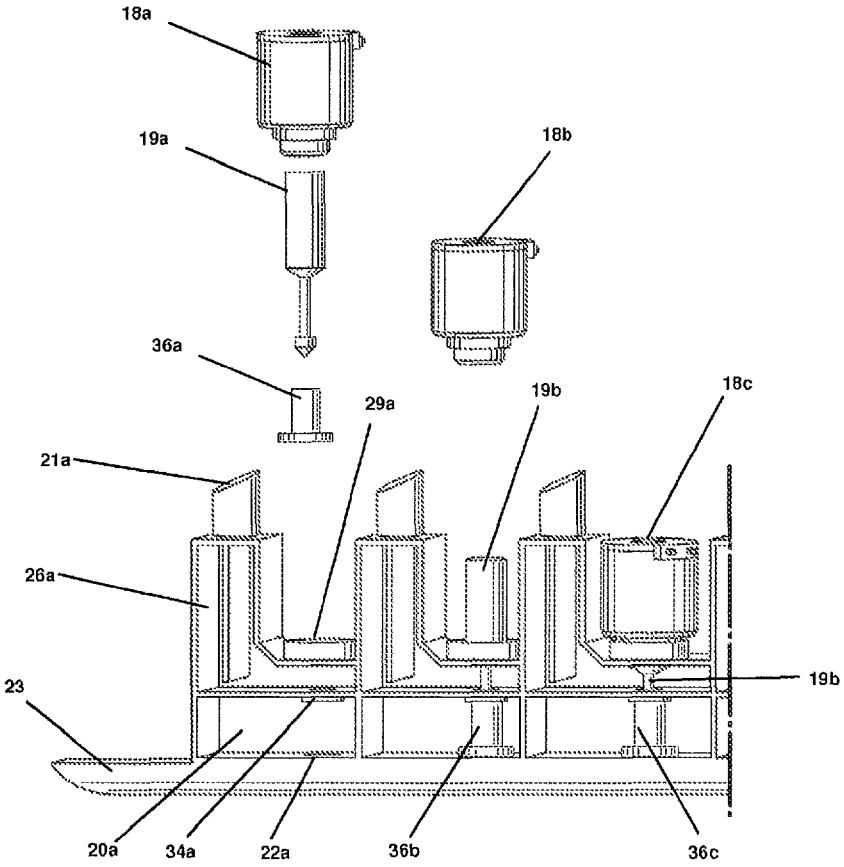
FIG. 12 is an exploded view of a component carrier according to an embodiment of the present invention.
Figure 13:
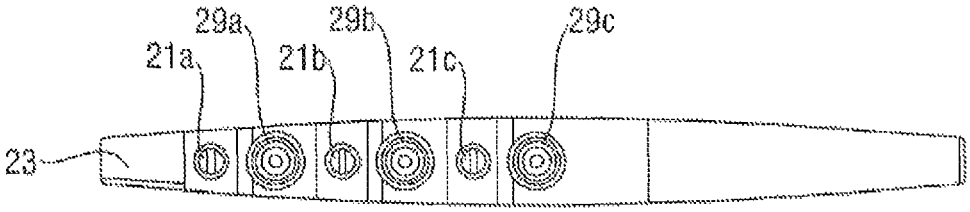
FIG. 13 is a plan view of a component carrier according to an embodiment of the present invention.

FIG. 13 shows the component carrier 23 known from FIG. 12 in plan view. It is clear that the dispensing chamber inlets 21*a-c* and the receptacles 29*a-c* for the actuators 18*a-c* are arranged in a line corresponding to the longitudinal axis of the component carrier 23.

Figure 14:
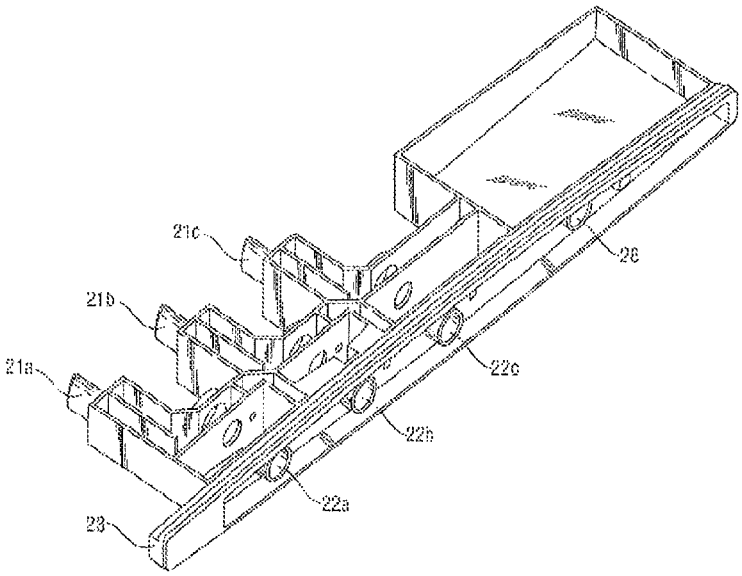
FIG. 14 is a perspective view of a component carrier and outlet orifices according to an embodiment of the present invention.

FIG. 14 shows the bottom of the component carrier 23 in perspective view. It is apparent that the dispensing chamber outlets 22*a-c* and the receptacle 28 for the sensor unit are of hollow-cylindrical construction, whereby the actual outlet orifice and the seal 36*a-c* closing the dispensing chamber outlets 22*a-c* are protected from mechanical damage.

Figure 15:
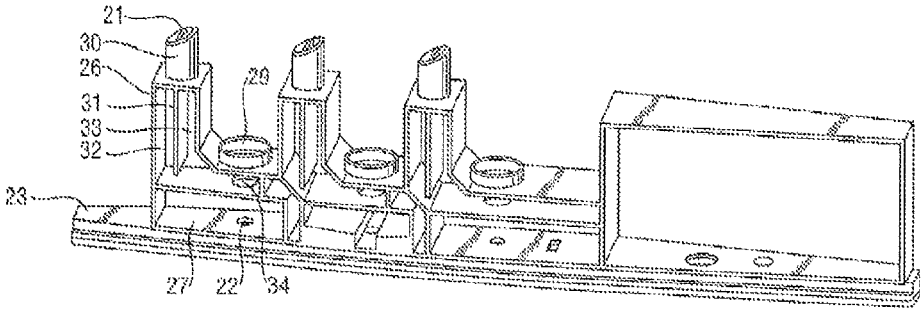
FIG. 15 is a perspective front view of a component carrier according to an embodiment of the present invention.

The ventilation system of the dispensing unit 2 is explained in greater detail with reference to FIG. 15. If a preparation is output from the dispensing chamber to the surrounding environment via the dispensing chamber outlet 22, the falling liquid level in the chambers of the cartridge 1 brings about a reduced pressure, as a result of which ambient air is sucked into the dispensing chamber inlet 22 and the outlet chamber 27 to equalize pressure. Via the orifice 34 the sucked-in ambient air climbs on upwards towards the cartridge 1 in accordance with the pressure gradient. In the predispensing chamber 26 of L-shaped construction, a chamber wall 31 extends inside the vertical leg, which chamber wall forms a first channel 32 and a second channel 33 in the region of the vertical leg. The chamber wall 31 guides the rising air into the right hand channel 33, such that this channel 33 functions primarily as a venting channel, while the other channel 32 primarily ensures that preparation continues to flow out of the cartridge 1.

The dispensing chamber inlet 21 is arranged on a connecting port 30, which is connected in communicating manner with the predispensing chamber 26. It is apparent that the chamber wall 31 also extends into the connecting port 30 and divides the latter into two separate channels.

Figure 16:
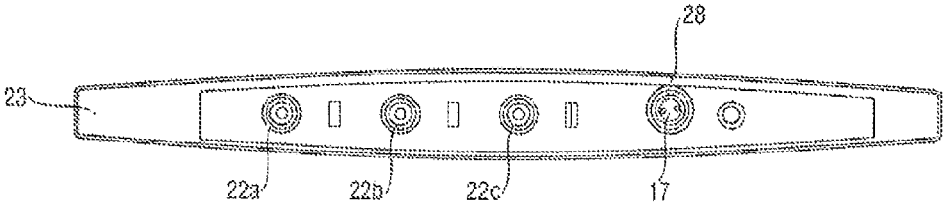
FIG. 16 is a bottom view of a component carrier according to an embodiment of the present invention.

FIG. 16 shows the bottom of the component carrier 23 in plan view. The dispensing chamber outlets 22*a-c* and the receptacle 28 for the sensor unit 17 are arranged in a line, which corresponds substantially to the longitudinal axis of the component carrier 23.

Figure 17:
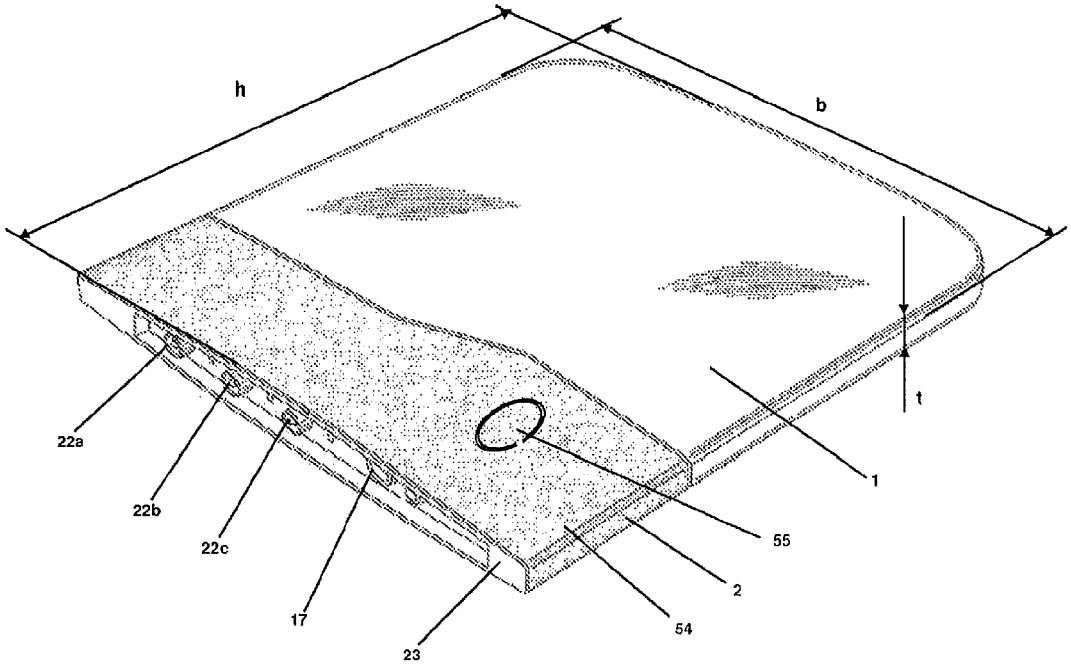
FIG. 17 is a perspective view of a dispenser assembled with a cartridge according to an embodiment of the present invention.

FIG. 17 shows the dispenser 2 assembled with the cartridge 1 in perspective view. In the assembled state the dispensing system has a height h, a width b and a depth t. The width b and the height h should not exceed 210 mm. The depth t should amount to less than 20 mm. The width/height/depth ratio should amount to approximately 10:10:1. The height h and the width b preferably correspond to the dimensions of a medium-sized dinner plate. Thus, the dispensing system may be positioned simply, in a manner which is intuitive for the user, in the corresponding dish holder of a dishwasher washing basket.

Figure 18:
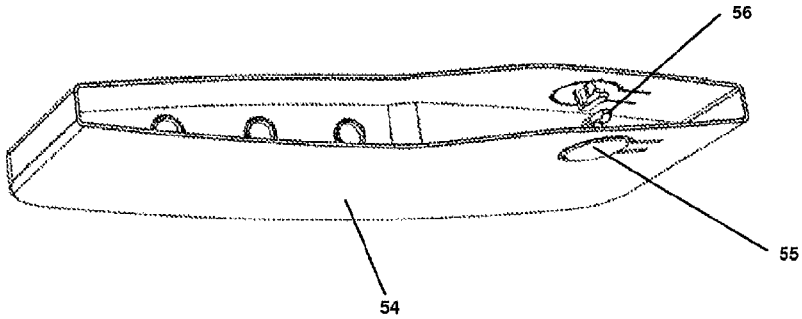
FIG. 18 is a perspective view of a bracket with a hinge according to an embodiment of the present invention.

FIG. 18 shows a perspective plan view of the bracket 54. It is apparent that a hook 56 is formed in each case inside on the hinge 55, which hook engages in a corresponding receptacle in the cartridge 1, so fixing the cartridge relative to the dispenser 2. The hooks 56 are situated substantially opposite one another. It is also conceivable for in total just one hook 56 to be arranged on the inside of the bracket 54.

Figure 19:
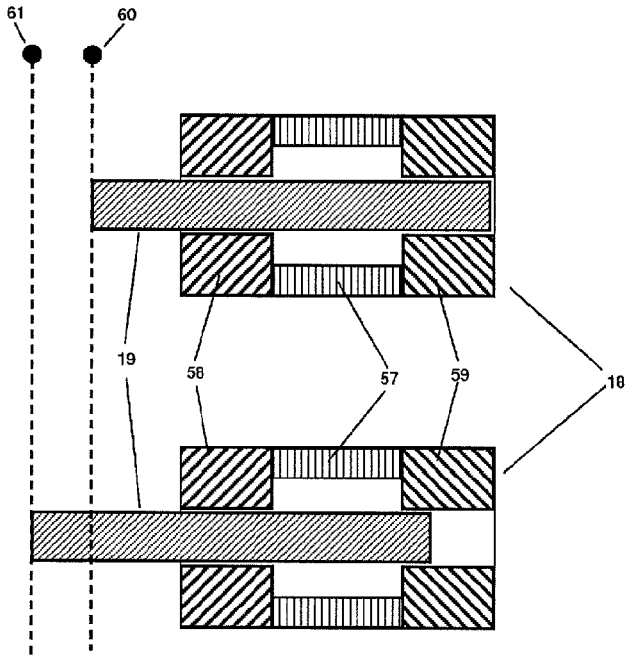
FIG. 19 is a diagram depicting an actuator configured as a bistable solenoid according to an embodiment of the present invention.

FIG. 19 is a schematic representation of a cross-sectional view through an actuator 18 configured as a bistable solenoid. It shows a first coil 58 and a second coil 59 with a permanent magnet 57 arranged between the coils 58, 59. The closing element 19 is accommodated as a plunger core in the circular coils 58, 59 and the circular permanent magnet 57. A retention force is generated by magnetic return between the magnetic field of the permanent magnet 57 and the magnetizable closing element 19, whereby the closing element 19 may be fixed in a position which is defined in each case by the retention points 60, 61.

The closing element 19 may be moved to the retention points 60 and 61 by pulsed energization of the coils 58, 59, by superimposing on the magnetic field of the permanent magnet 57 an electrically generated magnetic field in each case of one of the coils 58, 59 with appropriate polarization. If the coil 58 is energized, for example, interruption of the magnetic return between the permanent magnet 57 and the closing element 19 is brought about, such that the closing element 19 is subsequently moved into the magnetic field of the coil 58 from retention point 60 to retention point 61, which is clear from the bottom part of FIG. 19. If corresponding pulsed energization of the coils 59 is brought about, the closing element 19 moves back from retention point 61 into the starting position, retention point 60.

As already mentioned above, the dispensing system of the above-described type is in principle suitable for use in or in conjunction with water-conveying devices of any type. As explained in the earlier exemplary embodiments, the dispensing system according to the invention is in particular suitable for use in water-conveying domestic appliances such as dishwashing and/or washing machines, but is not limited to such use.

In general, it is possible to use the dispensing system according to the invention anywhere where dispensing of at least one, preferably a plurality of preparations into a liquid medium is required in accordance with an external physical or chemical parameter triggering or controlling a dispensing program. Further examples of application of the dispensing system according to the invention are therefore described in greater detail below.

Figure 20:
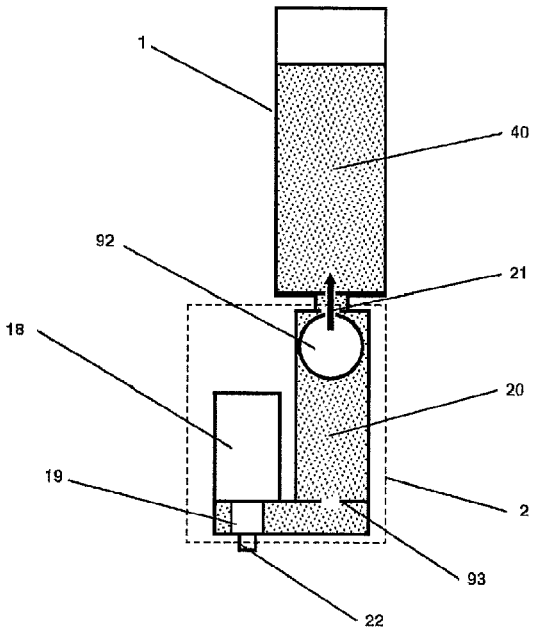
FIGS. 20 to 23 are diagrams depicting a dispensing chamber with a float according to various embodiments of the present invention.
Figure 21:
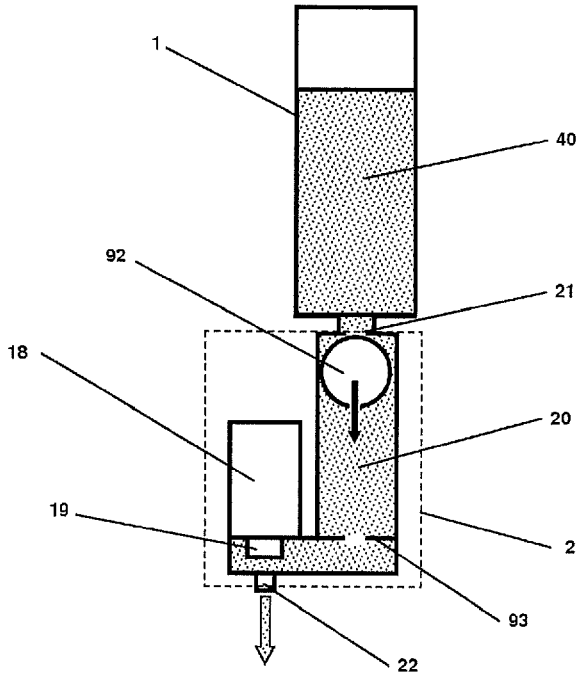

The mode of operation of the dispensing chamber 20 is explained in greater detail below with reference to FIGS. 20-23. FIG. 20 shows the dispenser 2 coupled to the cartridge 40. The preparation 40 may flow out of the cartridge 1 into the dispensing chamber 20 via the dispensing chamber inlet 21. The dispensing chamber 20 is of L-shaped cross-section, the actuator 18 in the form of a bistable solenoid valve being positioned above the short leg of the L-shaped dispensing chamber 20. The closing element 19 closes the dispensing chamber outlet 22 when the dispenser 2 is in the closure position. The L-shaped dispensing chamber 20 is subdivided by the diaphragm 93 into two portions, in which, as is readily apparent from FIGS. 20-23, the lower portion is substantially horizontal and the upper portion is substantially vertical. Inside the upper, vertical portion of the dispensing chamber 20, i.e. above the diaphragm 93 in the direction of gravity, the float 92 is arranged, whose density is lower than the density of the preparation 40 with which the dispensing chamber 20 is filled, whereby the float 92 exhibits buoyancy contrary to the direction of gravity, which is indicated by the arrow in FIG. 20.

The float 92 does not take the form of a closing member, but rather acts as a deliberate throttle which, on opening of the closing element 19, minimizes slippage between the dispensing chamber inlet 21 and dispensing chamber outlet 22 and so determines dispensing accuracy. The float is configured in such a way that it does not rest sealingly on or against the dispensing chamber inlet 21 and diaphragm 93 in its end positions, but rather also allows flow around and/or through the float 92 in the end positions.

The float 92 and the dispensing chamber 20 are configured such that preparation 40 may flow around and/or through the float 92 in the dispensing chamber 20.

Figure 22:
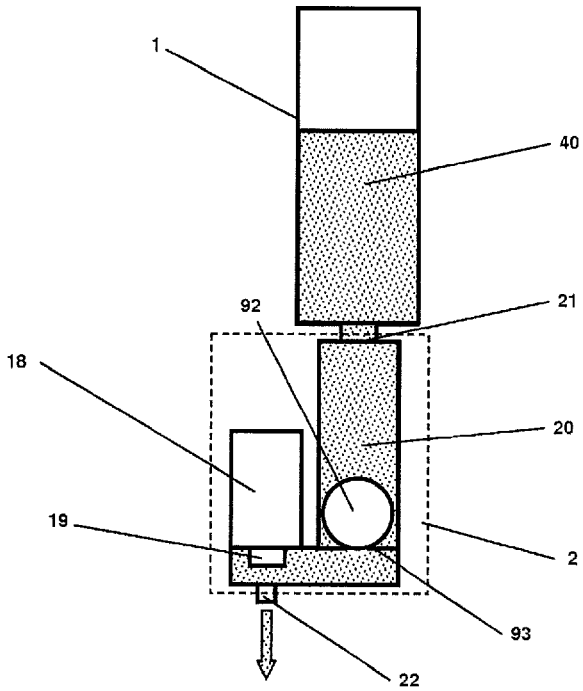

If the closing element 19 is then brought by the actuator 18 into a release position (FIG. 21), such that the dispensing chamber outlet 22 is opened and preparation 40 is released into the surrounding environment, which is indicated by the arrow, the float 92 moves with the preparation 40 flowing out of the dispensing chamber 20 in the flow direction of the preparation 40 towards the diaphragm 93, until the float 92 finally rests on the diaphragm 93, which is shown in FIG. 22.

If, as shown in FIG. 23, the closing element 19 is moved by the actuator 18 back into its closure position and the stream of preparation towards the dispensing chamber outlet 22 comes to a standstill, the float 92 moves, due to its buoyancy in the preparation 40, contrary to the direction of gravity in the dispensing chamber 20 towards the dispensing chamber inlet 21 until the starting position shown in FIG. 20 is reached once again.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A dispensing system (1, 2) for a user to position in the interior of a dishwashing machine, comprising at least one cartridge (1) for flowable washing or cleaning agents with a plurality of chambers (3*a*, 3*b*, 3*c*) for spatially separate accommodation of different preparations of the washing or cleaning agents, and a dispenser (2) couplable with the cartridge (1) and comprising at least one energy source (15), a control unit (16), a sensor unit (17), at least one actuator (18), which is connected with the energy source (15) and the control unit (16) in such a manner that a control signal from the control unit (16) brings about movement of the actuator (18), a closing element (19), which is coupled with the actuator (18) such that movement of the actuator (18) displaces the closing element (19) into a closure or a release position, at least one dispensing chamber (20) which, when the cartridge (1) and dispenser (2) are assembled, is connected in communicating manner with at least one of the cartridge chambers (3*a*, 3*b*, 3*c*), the dispensing chamber (20) comprising an inlet (21) for inflow of washing or cleaning agent from a cartridge chamber (3*a*, 3*b*, 3*c*) and an outlet (22) for outflow of washing or cleaning agent from the dispensing chamber (20) into its surrounding environment at least the outlet (22) of the dispensing chamber (20) being closable or openable by the closing element (19), wherein the dispenser (2) comprises a component carrier (23), on which components are detachably or nondetachably arranged, the components including at least the dispensing chamber (20), the actuator (18) and the closing element (19) as well as the energy source (15) and/or the control unit (16) and/or the sensor unit (17), and wherein the dispensing chamber (20) is L-shaped, a receptacle (29) for an actuator (18) being provided on a leg of the L-shaped dispensing chamber (20) which, in a service position, extends substantially horizontally.

2. The dispensing system according to claim 1, wherein the dispensing chamber (20) is of single-part construction with the component carrier (23).

3. The dispensing system according to claim 1, wherein the energy source (15), the control unit (16) and the sensor unit (17) are combined in an assembly arranged on or in the component carrier (23).

4. The dispensing system according to claim 1, wherein the component carrier (23) is of a trough-like design and manufactured as an injection molded part.

5. The dispensing system according to claim 4, wherein the trough-like component carrier (23) is closed in liquid-tight manner with a closing element.

6. The dispensing system according to claim 5, wherein the closing element is a film which is bonded in liquid-tight manner with the component carrier (23).

7. The dispensing system according to claim 5, wherein the closing element is a bracket (54), into which the component carrier (23) may be introduced, the component carrier (23) and the bracket (54) interacting in the assembled state in such a manner that a liquid-tight connection is formed between the component carrier (23) and the bracket (54).

8. The dispensing system according to claim 1, wherein the component carrier (23) comprises a receptacle for the actuator, the receptacle being arranged, when the dispenser (2) is in a service position, above the dispensing chamber outlet (22) in the direction of gravity.

9. The dispensing system according to claim 8, wherein, in a service position of the dispenser (2), the dispensing chamber inlet (21) is arranged on the component carrier (23) above the receptacle of the actuator (18).

10. The dispensing system according claim 1, further comprising:

a receptacle for the actuator (18), the receptacle comprising an orifice, which is in line with the dispensing chamber outlet (22); and a closing element (19) that may be moved to and fro by the actuator (18) through the orifice and the dispensing chamber outlet (22).

11. The dispensing system according to claim 1, wherein the dispensing chamber inlet comprises a plurality of inlets (21*a-c*), the dispenser outlet comprises a plurality of outlet orifices (22*a-c*), and the dispenser system comprises receptacles (29*a-c*) for the actuators (18*a-c*), the inlets (21*a-c*), the outlet orifices (22*a-c*), and the receptacles (29*a-c*) being arranged in a line which corresponds to a longitudinal axis of the component carrier (23).

12. The dispensing system according to claim 1, wherein the component carrier (23) is formed at least in portions of a transparent material.

13. The dispensing system according to claim 12, wherein the component carrier (23) comprises at least one light guide, via which light from the surrounding environment of the dispenser (2) may be guided to an optical transmit and/or receive unit into and/or out of the interior of the dispenser (2) or of the component carrier (23), the light guide in particular being formed in a single part with the component carrier (23).

14. The dispensing system according to claim 13, wherein at least one orifice is provided in the dispenser (2), through which orifice light from the surrounding environment of the dispenser (2) may be incoupled and/or outcoupled into and/or out of the light guide.

* * * * *